US009961731B2

(12) United States Patent
Reed

(10) Patent No.: US 9,961,731 B2
(45) Date of Patent: May 1, 2018

(54) LUMINAIRE WITH TRANSMISSIVE FILTER AND ADJUSTABLE ILLUMINATION PATTERN

(71) Applicant: Express Imaging Systems, LLC, Renton, WA (US)

(72) Inventor: William G. Reed, Seattle, WA (US)

(73) Assignee: EXPRESS IMAGING SYSTEMS, LLC, Renton, WA (US)

( * ) Notice: Subject to any disclaimer, the term of this patent is extended or adjusted under 35 U.S.C. 154(b) by 0 days. days.

(21) Appl. No.: 15/369,559

(22) Filed: Dec. 5, 2016

(65) Prior Publication Data

US 2017/0164439 A1 Jun. 8, 2017

Related U.S. Application Data

(60) Provisional application No. 62/264,694, filed on Dec. 8, 2015.

(51) Int. Cl.
*H05B 33/08* (2006.01)
*F21K 9/64* (2016.01)
(Continued)

(52) U.S. Cl.
CPC ..... *H05B 33/0827* (2013.01); *F21K 9/64* (2016.08); *F21S 8/086* (2013.01); *F21V 3/00* (2013.01);
(Continued)

(58) Field of Classification Search
CPC ..... H05B 33/0827; F21K 9/64; F21V 9/10; F21V 9/16
See application file for complete search history.

(56) References Cited

U.S. PATENT DOCUMENTS 6,746,274 B1 6/2004 Verfuerth
7,250,715 B2 7/2007 Mueller et al.
(Continued)

FOREIGN PATENT DOCUMENTS

CN 103162187 A 6/2013
EP 2 068 193 A2 6/2009
(Continued)

OTHER PUBLICATIONS

Renn et al., "Shade and Wavelength Converter for Solid State Luminaires," U.S. Appl. No. 15/681,927, filed Aug. 21, 2017, 48 pages.
(Continued)

*Primary Examiner* — Douglas W Owens
*Assistant Examiner* — Pedro C Fernandez
(74) *Attorney, Agent, or Firm* — Seed IP Law Group LLP

(57) ABSTRACT

Illumination systems with selectively adjustable illumination patterns which reduce the need for a utility or luminaire distributer to stock luminaires with different illumination patterns and reduce the need for pre-planning installations. Implementations may allow scheduled dimming of luminaires, dimming in defined physical directions and scheduled adjustment of light patterns. The efficiency and/or color contrast of a luminaire may be improved by using wavelength shifting material, such as a phosphor, to absorb less desired wavelengths and transmit more desired wavelengths. A transmissive filter may reflect desired wavelengths such as red and green, while passing less desired wavelengths (e.g., blue) toward the wavelength shifting material which emits such as light of more desirable wavelengths.

44 Claims, 18 Drawing Sheets

(51) Int. Cl.

| | |
|---|---|
| ***F21S 8/08*** | (2006.01) |
| ***F21V 29/76*** | (2015.01) |
| ***F21V 9/10*** | (2006.01) |
| ***F21V 15/01*** | (2006.01) |
| ***F21V 3/00*** | (2015.01) |
| ***H05B 37/02*** | (2006.01) |

(52) U.S. Cl.

CPC ..... *F21V 9/10* (2013.01); *F21V 15/01* (2013.01); *F21V 29/763* (2015.01); *H05B 37/0263* (2013.01); *H05B 37/0272* (2013.01)

(56) References Cited

U.S. PATENT DOCUMENTS

| | | | | |
|---|---|---|---|---|
| 7,638,743 | B2 | 12/2009 | Bartol et al. | |
| 8,118,456 | B2 | 2/2012 | Reed et al. | |
| 8,169,135 | B2 * | 5/2012 | Zhai | F21K 9/64 257/678 |
| 8,334,640 | B2 | 12/2012 | Reed et al. | |
| 8,344,665 | B2 | 1/2013 | Verfuerth et al. | |
| 8,378,563 | B2 * | 2/2013 | Reed | F21V 7/05 313/112 |
| 8,406,937 | B2 | 3/2013 | Verfuerth et al. | |
| 8,445,826 | B2 | 5/2013 | Verfuerth | |
| 8,450,670 | B2 | 5/2013 | Verfuerth et al. | |
| 8,476,565 | B2 | 7/2013 | Verfuerth | |
| 8,508,137 | B2 | 8/2013 | Reed | |
| 8,541,950 | B2 | 9/2013 | Reed | |
| 8,545,029 | B2 | 10/2013 | Ma et al. | |
| 8,586,902 | B2 | 11/2013 | Verfuerth | |
| 8,604,701 | B2 | 12/2013 | Verfuerth et al. | |
| 8,610,358 | B2 | 12/2013 | Reed | |
| 8,629,621 | B2 | 1/2014 | Reed | |
| 8,637,877 | B2 | 1/2014 | Negley | |
| 8,666,559 | B2 | 3/2014 | Verfuerth et al. | |
| 8,779,340 | B2 | 7/2014 | Verfuerth et al. | |
| 8,810,138 | B2 | 8/2014 | Reed | |
| 8,866,582 | B2 | 10/2014 | Verfuerth et al. | |
| 8,872,964 | B2 | 10/2014 | Reed et al. | |
| 8,878,440 | B2 | 11/2014 | Reed | |
| 8,884,203 | B2 | 11/2014 | Verfuerth et al. | |
| 8,896,215 | B2 | 11/2014 | Reed et al. | |
| 8,901,825 | B2 | 12/2014 | Reed | |
| 8,922,124 | B2 | 12/2014 | Reed et al. | |
| 8,926,138 | B2 | 1/2015 | Reed et al. | |
| 8,926,139 | B2 | 1/2015 | Reed et al. | |
| 8,987,992 | B2 | 3/2015 | Reed | |
| 9,185,777 | B2 | 11/2015 | Reed | |
| 9,210,751 | B2 | 12/2015 | Reed | |
| 9,210,759 | B2 | 12/2015 | Reed | |
| 9,312,451 | B2 | 4/2016 | Reed et al. | |
| 9,466,443 | B2 | 10/2016 | Reed | |
| 2006/0145172 | A1 | 7/2006 | Su et al. | |
| 2007/0285000 | A1 | 12/2007 | Lim et al. | |
| 2008/0284316 | A1 | 11/2008 | Kurihara et al. | |
| 2009/0101930 | A1 | 4/2009 | Li | |
| 2010/0123403 | A1 | 5/2010 | Reed | |
| 2010/0149483 | A1 | 6/2010 | Chiavetta, III | |
| 2010/0259924 | A1 | 10/2010 | Dong | |
| 2011/0026264 | A1 | 2/2011 | Reed et al. | |
| 2011/0310605 | A1 | 12/2011 | Renn et al. | |
| 2012/0038490 | A1 | 2/2012 | Verfuerth | |
| 2012/0209755 | A1 | 8/2012 | Verfuerth et al. | |
| 2012/0224363 | A1 * | 9/2012 | Van De Ven | H01L 33/505 362/231 |
| 2013/0033183 | A1 | 2/2013 | Verfuerth et al. | |
| 2013/0131882 | A1 | 5/2013 | Verfuerth et al. | |
| 2013/0163243 | A1 | 6/2013 | Reed | |
| 2013/0229518 | A1 | 9/2013 | Reed et al. | |
| 2013/0293112 | A1 | 11/2013 | Reed et al. | |
| 2014/0028198 | A1 | 1/2014 | Reed et al. | |
| 2014/0055990 | A1 | 2/2014 | Reed | |
| 2014/0078308 | A1 | 3/2014 | Verfuerth | |
| 2014/0097759 | A1 | 4/2014 | Verfuerth et al. | |
| 2014/0159585 | A1 | 6/2014 | Reed | |
| 2014/0180491 | A1 | 6/2014 | Verfuerth et al. | |
| 2014/0225521 | A1 | 8/2014 | Reed | |
| 2015/0015716 | A1 | 1/2015 | Reed et al. | |
| 2015/0077019 | A1 | 3/2015 | Reed et al. | |
| 2015/0078005 | A1 | 3/2015 | Renn et al. | |
| 2015/0084520 | A1 | 3/2015 | Reed | |
| 2015/0137693 | A1 | 5/2015 | Reed | |

FOREIGN PATENT DOCUMENTS

| | | | |
|---|---|---|---|
| JP | 11-45519 | A | 2/1999 |
| JP | 2004-193580 | A | 7/2004 |
| JP | 2004-193581 | A | 7/2004 |
| JP | 2008-010518 | A | 1/2008 |
| JP | 2009-071254 | A | 4/2009 |
| JP | 2009-105379 | A | 5/2009 |
| JP | 2009-251511 | A | 10/2009 |
| JP | 2010-250259 | A | 11/2010 |
| JP | 2011-501362 | A | 1/2011 |
| JP | 2011-528490 | A | 11/2011 |
| WO | 2004/068182 | A2 | 8/2004 |
| WO | 2009/052093 | A1 | 4/2009 |
| WO | 2009/107052 | A1 | 9/2009 |
| WO | 2009/137696 | A1 | 11/2009 |
| WO | 2009/140141 | A1 | 11/2009 |
| WO | 2010/057115 | A2 | 5/2010 |
| WO | 2010/127138 | A2 | 11/2010 |
| WO | 2010/133719 | A1 | 11/2010 |
| WO | 2010/135575 | A2 | 11/2010 |
| WO | 2010/135577 | A2 | 11/2010 |
| WO | 2010/135582 | A2 | 11/2010 |
| WO | 2011/088363 | A2 | 7/2011 |
| WO | 2011/163334 | A1 | 12/2011 |
| WO | 2012/142115 | A2 | 10/2012 |
| WO | 2013/028834 | A1 | 2/2013 |
| WO | 2013/040333 | A1 | 3/2013 |
| WO | 2014/018773 | A1 | 1/2014 |
| WO | 2014/039683 | A1 | 3/2014 |
| WO | 2014/078854 | A1 | 5/2014 |
| WO | 2015/013437 | A1 | 1/2015 |
| WO | 2015/039120 | A1 | 3/2015 |
| WO | 2015/116812 | A1 | 8/2015 |
| WO | 2016/054085 | A1 | 4/2016 |
| WO | 2016/064542 | A1 | 4/2016 |
| WO | 2016/081071 | A1 | 5/2016 |

OTHER PUBLICATIONS

Communication pursuant to Article 94(3) EPC, dated Feb. 5, 2016, for corresponding European Application No. 11 733 467.2-1755, 7 pages.

Communication pursuant to Article 94(3) EPC, dated Jun. 3, 2015, for corresponding European Application No. 11 733 467.2-1755, 12 pages.

Extended European Search Report, dated Feb. 17, 2015, for corresponding European Application No. 12832462.1, 8 pages.

Extended European Search Report, dated Sep. 11, 2014, for corresponding European Application No. 11733467.2, 5 pages.

International Search Report, dated Jan. 2, 2013, for PCT/US2012/055379, 3 pages.

International Search Report, dated Sep. 30, 2011 for PCT/US2011/021359, 3 pages.

Japanese Office Action, dated Apr. 7, 2015, for corresponding Japanese Application No. 2012-549127, with English translation, 7 pages.

Japanese Office Action, dated Sep. 9, 2014, for corresponding Japanese Application No. 2012-549127, with English translation, 7 pages.

Reed et al., "Adjustable Output Solid-State Lamp With Security Features," U.S. Appl. No. 61/561,616, filed Nov. 18, 2011, 33 pages.

Reed et al., "Apparatus and Method of Operating a Luminaire," U.S. Appl. No. 14/816,754, filed Aug. 3, 2015, 84 pages.

Reed et al., "Apparatus, Method to Change Light Source Color Temperature With Reduced Optical Filtering Losses," Notice of Allowance, dated Oct. 15, 2012, for U.S. Appl. No. 13/007,080, 9 pages.

(56) References Cited

OTHER PUBLICATIONS

Reed et al., "Apparatus, Method to Change Light Source Color Temperature with Reduced Optical Filtering Losses," U.S. Appl. No. 61/295,519, filed Jan. 15, 2010, 35 pages.
Reed et al., "Apparatus, Method to Change Light Source Color Temperature With Reduced Optical Filtering Losses," U.S. Appl. No. 61/406,490, filed Oct. 25, 2010, 46 pages.
Reed et al., "Apparatus, Method to Enhance Color Contrast in Phosphor-Based Solid State Lights," U.S. Appl. No. 13/619,085, Amendment filed Aug. 20, 2015, 14 pages.
Reed et al., "Apparatus, Method to Enhance Color Contrast in Phosphor-Based Solid State Lights," U.S. Appl. No. 13/619,085, Notice of Allowance dated Dec. 2, 2015, 9 pages.
Reed et al., "Apparatus, Method to Enhance Color Contrast in Phosphor-Based Solid State Lights," U.S. Appl. No. 13/619,085, Office Action dated May 20, 2015, 13 pages.
Reed et al., "Apparatus, Method to Enhance Color Contrast in Phosphor-Based Solid State Lights," U.S. Appl. No. 61/534,722, filed Sep. 14, 2011, 53 pages.
Reed et al., "Electrically Isolated Heat Sink for Solid-State Light," U.S. Appl. No. 61/229,435, filed Jul. 29, 2009, 29 pages.
Reed et al., "Gas-Discharge Lamp Replacement With Passive Cooling," U.S. Appl. No. 61/174,913, filed May 1, 2009, 29 pages.
Reed et al., "Gas-Discharge Lamp Replacement," U.S. Appl. No. 61/052,924, filed May 13, 2008, 32 pages.
Reed et al., "Long-Range Motion Detection for Illumination Control," U.S. Appl. No. 61/180,017, filed May 20, 2009, 32 pages.
Reed et al., "Low-Profile Pathway Illumination System," U.S. Appl. No. 61/051,619, filed May 8, 2008, 25 pages.
Reed et al., "Luminaire With Adjustable Illumination Pattern," U.S. Appl. No. 14/939,856, filed Nov. 12, 2015, 69 pages.
Reed et al., "Remotely Adjustable Solid-State Lamp," U.S. Appl. No. 61/641,781, filed May 2, 2012, 65 pages.
Reed et al., "Turbulent Flow Cooling for Electronic Ballast," U.S. Appl. No. 61/088,651, filed Aug. 13, 2008, 23 pages.
Reed, "Adjustable Output Solid-State Lighting Device," U.S. Appl. No. 61/567,308, filed Dec. 6, 2011, 49 pages.
Reed, "Aluminaire With Transmissive Filter and Adjustable Illumination Pattern," U.S. Appl. No. 62/264,694, filed Dec. 8, 2015, 78 pages.
Reed, "Ambient Light Control in Solid State Lamps and Luminaires," U.S. Appl. No. 61/933,733, filed Jan. 30, 2014, 8 pages.
Reed, "Apparatus and Method of Energy Efficient Illumination," U.S. Appl. No. 61/333,983, filed May 12, 2010, 57 pages.
Reed, "Apparatus and Method of Energy Efficient Illumination," U.S. Appl. No. 61/346,263, filed May 19, 2010, 67 pages.
Reed, "Apparatus, Retrofit Kit, and Method of Energy Efficient Illumination Using Adjustment Schedules," U.S. Appl. No. 62/208,403, filed Aug. 21, 2015, 100 pages.
Reed, "Asset Management System for Outdoor Luminaires," U.S. Appl. No. 14/869,501, filed Sep. 29, 2015, 57 pages.
Reed, "Asset Management System for Outdoor Luminaires," U.S. Appl. No. 62/082,463, filed Nov. 20, 2014, 56 pages.
Reed, "Centralized Control Area Lighting Hours of Illumination," U.S. Appl. No. 14/869,511, filed Sep. 29, 2015, 39 pages.
Reed, "Centralized Control Area Lighting Hours of Illumination," U.S. Appl. No. 62/057,419, filed Sep. 30, 2014, 39 pages.
Reed, "Detection and Correction of Faulty Photo Controls in Outdoor Luminaires," U.S. Appl. No. 14/869,492, filed Sep. 29, 2015, 71 pages.
Reed, "Detection and Correction of Faulty Photo Controls in Outdoor Luminaires," U.S. Appl. No. 62/068,517, filed Oct. 24, 2014, 47 pages.
Reed, "Detection and Correction of Faulty Photo Controls in Outdoor Luminaires," U.S. Appl. No. 62/183,505, filed Jun. 23, 2015, 71 pages.
Reed, "Electronic Control to Regulate Power for Solid-State Lighting and Methods Thereof," U.S. Appl. No. 61/115,438, filed Nov. 17, 2008, 51 pages.
Reed, "Electronic Control to Regulate Power for Solid-State Lighting and Methods Thereof," U.S. Appl. No. 14/806,500, filed Jul. 22, 2015, 52 pages.
Reed, "Electronic Control to Regulate Power for Solid-State Lighting and Methods Thereof," U.S. Appl. No. 61/154,619, filed Feb. 23, 2009, 62 pages.
Reed, "High Efficiency Power Controller for Luminaire," U.S. Appl. No. 61/905,699, filed Nov. 18, 2013, 5 pages.
Reed, "Low Power Photocontrol for Luminaire," Office Action dated Apr. 27, 2016, for U.S. Appl. No. 14/844,944, 10 pages.
Reed, "Low Power Photocontrol for Luminaire," U.S. Appl. No. 62/137,666, filed Mar. 24, 2015, 36 pages.
Reed, "Luminaire With Adjustable Illumination Pattern," U.S. Appl. No. 62/114,826, filed Feb. 11, 2015, 68 pages.
Reed, "Luminaire With Ambient Sensing and Autonomous Control Capabilities," U.S. Appl. No. 14/950,823, filed Nov. 24, 2015, 72 pages.
Reed, "Luminaire With Ambient Sensing and Autonomous Control Capabilities," U.S. Appl. No. 61/728,150, filed Nov. 19, 2012, 83 pages.
Reed, "Luminaire With Atmospheric Electrical Activity Detection and Visual Alert Capabilities," U.S. Appl. No. 61/649,159, filed Aug. 28, 2012, 52 pages.
Reed, "Luminaire With Switch-Mode Converter Power Monitoring," U.S. Appl. No. 61/723,675, filed Nov. 7, 2012, 73 pages.
Reed, "Photocontrol for Luminaire Consumes Very Low Power," U.S. Appl. No. 61/849,841, filed Jul. 24, 2013, 41 pages.
Reed, "Resonant Network for Reduction of Flicker Perception in Solid State Lighting Systems," U.S. Appl. No. 61/527,029, filed Aug. 24, 2011, 41 pages.
Reed, "Solid State Hospitality Lamp," U.S. Appl. No. 61/692,619, filed Aug. 23, 2012, 32 pages.
Reed, "Solid State Lighting, Drive Circuit and Method of Driving Same," U.S. Appl. No. 61/640,963, filed May 1, 2012, 24 pages.
Reed, "Systems, Methods, and Apparatuses for Using a High Current Switching Device as a Logic Level Sensor," U.S. Appl. No. 61/764,395, filed Feb. 13, 2013, 48 pages.
Renn et al., "Solid State Lighting Device and Method Employing Heat Exchanger Thermally Coupled Circuit Board," U.S. Appl. No. 61/357,421, filed Jun. 22, 2010, 49 pages.
Renn et al., "Solid-State Lighting Devices and Systems," U.S. Appl. No. 61/878,425, filed Sep. 16, 2013, 32 pages.
Written Opinion, dated Sep. 30, 2011, for PCT/US2011/021359, 4 pages.
Written Opinion, dated Jan. 2, 2013, for PCT/US2012/055379, 5 pages.

* cited by examiner

LUMINAIRE WITH TRANSMISSIVE FILTER AND ADJUSTABLE ILLUMINATION PATTERN

BACKGROUND

Field

This disclosure generally relates to luminaires that employ active light sources.

Description of the Related Art

Luminaires exist in a broad range of designs suitable for various uses. Some luminaires illuminate interior spaces, while others illuminate exterior spaces. Some luminaires are used to provide information, for example, forming part of or all of a display panel. Active lighting sources take a variety of forms, for example incandescent lamps, high-intensity discharge (HID) lamps (e.g., mercury vapor lamps, high-pressure sodium lamps, metal halide lamps), and solid-state light sources for instance light emitting diodes (LEDs).

Luminaires have a number of defining characteristics, including intensity (e.g., lumens), focus or dispersion, and temperature of the emitted light. For light sources that emit light by thermal radiation (e.g., incandescent filament), the color temperature (CT) of the light source is the temperature of an ideal black-body radiator that radiates light of comparable hue to that of the light source. Light sources that emit light by processes other than thermal radiation (e.g., solid state light sources) do not follow the form of a black-body spectrum. These light sources are assigned various correlated color temperatures (CCT) to indicate, to human color perception, the color temperature that most closely matches the light emitted.

Achieving desired lighting typically requires selecting suitable light sources, lenses, reflectors and/or housings based at least in part on the defining characteristics, the environment in which the luminaire will be used, and the desired level of performance.

LEDs are becoming increasingly popular due to their high energy efficiency, robustness, and long life performance. Typically, practical LEDs are capable of emitting light in a relatively narrow band. Since white light is often desirable, solid-state lighting systems typically employ "white" LEDs. These "white" LEDs may be manufactured by placing a phosphor layer either directly on a blue emitting LED die or onto a lens or window through which an LED will emit light. The phosphor layer is typically designed to convert radiation in the 440 nanometer to 480 nanometer wavelength range (mostly blue light) into a wider spectrum consisting of longer visible wavelengths that, when added to residual blue light, will appear as a pleasing white light. A variety of white LEDs are commercially available from a variety of manufacturers. Commercially available white LEDs range from "cool" white with a CCT of approximately 6000 Kelvin (K) to "warm" white with a CCT of approximately 3000 K.

In addition to the performance parameters described above, lighting of homes, offices and other areas often has aesthetic concerns that are as important as the amount of illumination produced by the lighting system. Unlike an ideal black body radiator or natural daylight, solid-state lighting systems do not produce light that has a smooth and continuous spectral power distribution, despite the appearance of "white" light.

It is known that phosphor-coated white LEDs permit some blue light to escape conversion by the phosphor. The blue light differs from natural light and also may appear harsh or otherwise unpleasing. In addition, other aesthetic concerns often favor an emission spectrum that has more red and green wavelengths than would come from a true black body radiator. This type of light enhances the colors and color contrasts of furnishings and décor.

Although red and green light can be added to white LEDs to provide a more pleasing spectrum, this method may result in significant added cost for the extra LEDs and drive electronics, while the blue wavelength spike in the output spectrum remains.

Absorption filtered lamps, such as the General Electric's REVEAL® light bulbs) typically incorporate a filter element, such as neodymium, into the glass bulb to filter out the dull yellow light produced by the incandescent filament, thereby enhancing the appearance of the more vibrant light such as red. The addition of such a filter, however, causes a significant loss of light output, leading to a very low efficiency. For example, a REVEAL® 60 W bulb has a Lumens/Watt rating of only 11. Although an LED lamp may have a rating of 65 L/W to 100 L/W, it can be expected that adding absorption filters would similarly reduce the efficiency as well as the light output, because the undesirable light is filtered and dissipated as heat. The heat added to the system from the absorptive filter may also contribute to lowering the life expectancy of the LED.

Adjusting the phosphor formulation of white LED lamps is also inadequate in providing the desired pleasing light in an LED, due to the wideband nature of the phosphor's emission spectrum. In other words, a narrow band of wavelengths typically cannot be removed from the white LED output spectrum by adjusting the phosphor formulation.

Lighting systems are designed to have specific illumination patterns, for example, outdoor luminaires may have National Electrical Manufacturers Association (NEMA) Type 1, 2, 3, 4 or 5 illumination patterns. Indoor applications may require unique illumination patterns to properly light complex interior spaces, for example retail stores. Other non-standardized light patterns are desirable in some installations, to provide higher light levels in certain locations and lower light levels in other locations. For example, a NEMA Type 5 outdoor luminaire is designed to provide light in a square or circular pattern on the ground, whereas a NEMA Type 3 pattern has an oblong light distribution more suitable for roadway lighting.

In some installations, none of the standard illumination patterns is acceptable. For example, a NEMA Type 5 luminaire mounted near a residence may properly illuminate a yard and driveway, but may also project an objectionable amount of light into the windows of the residence. In such a case the luminaire installer may receive a complaint from the resident and then return to the installation to install a light shield or mask, or paint the luminaire's refractor to reduce the objectionable light illuminating the residence. This is a very expensive alteration due to the time and cost of a "bucket truck" and service person.

Interior light distribution patterns may require more than one luminaire to achieve appropriate light levels in all areas. Most lighting stores, utilities, electric companies, rural electric cooperatives and other providers of luminaire installations stock several types of luminaires so that the proper illumination pattern luminaire will be available for installation in any situation. This is a significant expense in inventory and record keeping, and complicates the installation plan.

BRIEF SUMMARY

A luminaire may be summarized as including: an active light source which emits light across a plurality of wavelengths; at least one transmissive filter positioned in a first portion of an optical path of the active light source between the active light source and an optical exit of the luminaire to receive an incident portion of the emitted light, the at least one transmissive filter positioned outside of a second portion of the optical path such that a non-incident portion of the emitted light in the second portion of the optical path exits the optical exit of the luminaire without striking the at least one transmissive filter, the at least one transmissive filter transmits light of the incident portion having a wavelength in a first set of wavelengths in the plurality of wavelengths and reflects light of the incident portion having a wavelength in a second set of wavelengths in the plurality of wavelengths; and a wavelength shifter positioned and oriented to receive the transmitted portion of the incident portion and in response emit light at a shifted wavelength toward the optical exit of the luminaire.

The wavelength shifter may include molded plastic loaded with phosphor. The wavelength shifter may include a layer of coating disposed on at least one exterior-facing surface of the at least one transmissive filter. The at least one transmissive filter may include a substrate having a dielectric coating thereon. The at least one transmissive filter may include a layer of coating disposed on at least one light source-facing surface of the wavelength shifter. The active light source may include at least one solid state light source. The active light source may include at least one light emitting diode. The wavelength shifter may include at least one phosphor material. The at least one transmissive filter may include an optical element and a number of layers of at least one of a dichroic coating or a dielectric mirror material carried by the optical element. The optical element may be at least part of the optical exit of the luminaire. The luminaire may further include: a lens positioned and oriented to receive the shifted emitted light from the wavelength shifter and in response emit light which is at least one of refracted or diffracted toward the optical exit of the luminaire. The first set of wavelengths may include wavelengths below approximately 480 nanometers and the second set of wavelengths may include wavelengths above approximately 480 nanometers, and the wavelength shifter may emit light at wavelengths above approximately 480 nanometers. The luminaire may further include: at least one circuit board; wherein the active light source includes: a number N of solid-state light emitter arrays carried on the at least one circuit board, the number N greater than or equal to two, each of the N solid-state light emitter arrays including a plurality of solid-state light emitters, at least some of the plurality of solid-state light emitters of one of the N solid-state light emitter arrays positioned at a different angle from at least some of the solid-state light emitters of at least one of the other N solid-state light emitter arrays; a solid-state light emitter driver including N independently controllable driver channels, each of the N driver channels electrically coupled to a different one of the N solid-state light emitter arrays; at least one luminaire processor operatively coupled to the solid-state light emitter driver to control the operation thereof; at least one luminaire transceiver operatively coupled to the at least one luminaire processor and to at least one data communications channel; and at least one luminaire nontransitory processor-readable storage medium operatively coupled to the at least one luminaire processor and which stores at least one of data or instructions which, when executed by the at least one luminaire processor, cause the at least one luminaire processor to: receive, via the at least one luminaire transceiver, illumination pattern information from a remotely located external processor-based system over the at least one data communications channel, the illumination pattern information indicative of an illumination pattern to be produced by the N solid-state light emitter arrays; store the received illumination pattern information in the at least one nontransitory processor-readable storage medium; and control the operation of the solid-state light emitter driver based at least in part on the illumination pattern information. The received illumination pattern information may specify an instruction to control the solid-state light emitter driver to drive at least one of the N independently controllable driver channels differently from the other of the N independently controllable driver channels. The received illumination pattern information may specify an instruction to control the solid-state light emitter driver to drive each of the N independently controllable driver channels so that the plurality of solid-state light emitters of the N solid-state light emitter arrays produce at least one of a plurality of determined standardized illumination patterns. The received illumination pattern information may specify an instruction to control the solid-state light emitter driver to drive each of the N independently controllable driver channels so that the plurality of solid-state light emitters of the N solid-state light emitter arrays produce at least one of a National Electrical Manufacturers Association (NEMA) illumination pattern or an Illuminating Engineering Society of North America (IESNA) illumination pattern. The received illumination pattern information may specify an instruction to control the solid-state light emitter driver to drive each of the N independently controllable driver channels so that each of the plurality of solid-state light emitters of at least one of the N solid-state light emitter arrays are at least one of disabled or dimmed. The at least one circuit board may be a flexible printed circuit board. The at least one luminaire transceiver may receive the illumination pattern information from the external processor-based system over at least one radio or microwave frequency channel. The at least one luminaire transceiver may receive the illumination pattern information from the external processor-based system over at least one of a short-range wireless channel or a wired communications channel. The at least one luminaire transceiver may receive the illumination pattern information from the external processor-based system through at least one power-line power distribution system. The at least one luminaire transceiver may receive the illumination pattern information from at least one of a smartphone, a tablet computer, or a notebook computer. The at least one luminaire transceiver may receive the illumination pattern information from the external processor-based system over the at least one data communications channel, the illumination pattern information indicative of a notification illumination pattern to be produced by the N solid-state light emitter arrays, the notification illumination pattern provides a notification to humans that view the luminaire when the plurality of solid-state light emitters are illuminated according to the notification illumination pattern.

A method of providing a luminaire may be summarized as including: providing an active light source; positioning at least one transmissive filter in a first portion of an optical path of the active light source between the active light source and an optical exit of the luminaire to receive an incident portion of light emitted from the active light source, the at least one transmissive filter positioned outside of a second portion of the optical path such that a non-incident portion of the emitted light in the second portion of the optical path exits the optical exit of the luminaire without striking the at least one transmissive filter, the at least one transmissive filter transmits light of the incident portion having a wavelength in a first set of wavelengths and reflects light of the incident portion having a wavelength in a second set of wavelengths; and positioning and orienting a wavelength shifter to receive the transmitted portion of the incident portion and in response emit light at a shifted wavelength toward the optical exit of the luminaire.

Positioning and orienting a wavelength shifter may include positioning and orienting a wavelength shifter which includes molded plastic loaded with phosphor. Positioning and orienting a wavelength shifter may include positioning and orienting a wavelength shifter which includes a layer of coating disposed on at least one exterior facing surface of the at least one transmissive filter. Positioning at least one transmissive filter may include positioning at least one transmissive filter including a substrate having a dielectric coating thereon. Positioning at least one transmissive filter may include positioning at least one transmissive filter including a layer of coating disposed on at least one light-source facing surface of the wavelength shifter. Positioning at least one transmissive filter in a first portion of an optical path of an active light source may include positioning at least one transmissive filter in a first portion of an optical path of at least one solid state light source. Positioning at least one transmissive filter in a first portion of an optical path of an active light source may include positioning at least one transmissive filter in a first portion of an optical path of at least one light emitting diode. Positioning and orienting a wavelength shifter may include positioning and orienting a wavelength shifter which includes at least one phosphor material. Positioning at least one transmissive filter may include positioning at least one transmissive filter including an optical element and a number of layers of at least one of a dichroic coating or a dielectric mirror material carried by the optical element. The method may further include: positioning and orienting a lens to receive the shifted emitted light from the wavelength shifter and in response emit light which is at least one of refracted or diffracted toward the optical exit of the luminaire. Positioning at least one transmissive filter may include positioning at least one transmissive filter which transmits light having a wavelength below approximately 480 nanometers and reflects light having a wavelength above 480 nanometers, and positioning and orienting a wavelength shifter may include positioning and orienting a wavelength shifter which emits light at wavelengths above 480 nanometers. Providing an active light source may include providing an active light source which includes: at least one circuit board; a number N of solid-state light emitter arrays carried on the at least one circuit board, the number N greater than or equal to two, each of the N solid-state light emitter arrays including a plurality of solid-state light emitters, at least some of the plurality of solid-state light emitters of one of the N solid-state light emitter arrays positioned at a different angle from at least some of the solid-state light emitters of at least one of the other N solid-state light emitter arrays; a solid-state light emitter driver including N independently controllable driver channels, each of the N driver channels electrically coupled to a different one of the N solid-state light emitter arrays; at least one luminaire processor operatively coupled to the solid-state light emitter driver to control the operation thereof; at least one luminaire transceiver operatively coupled to the at least one luminaire processor and to at least one data communications channel; and at least one luminaire nontransitory processor-readable storage medium operatively coupled to the at least one luminaire processor; the method may further include: receiving, by the at least one luminaire transceiver, illumination pattern information from a remotely located external processor-based system over the at least one data communications channel, the illumination pattern information indicative of an illumination pattern to be produced by the N solid-state light emitter arrays; storing the received illumination pattern information in the at least one nontransitory processor-readable storage medium; and controlling the operation of the solid-state light emitter driver based at least in part on the illumination pattern information. Receiving illumination pattern information may include receiving an illumination pattern information that specifies an instruction to control the solid-state light emitter driver to drive at least one of the N independently controllable driver channels differently from the other of the N independently controllable driver channels. Receiving illumination pattern information may include receiving an illumination pattern information that specifies an instruction to control the solid-state light emitter driver to drive each of the N independently controllable driver channels so that the plurality of solid-state light emitters of the N solid-state light emitter arrays produce a determined standardized illumination pattern. Receiving illumination pattern information may include receiving an illumination pattern information that specifies an instruction to control the solid-state light emitter driver to drive each of the N independently controllable driver channels so that the plurality of solid-state light emitters of the N solid-state light emitter arrays produce at least one of a National Electrical Manufacturers Association (NEMA) illumination pattern or an Illuminating Engineering Society of North America (IESNA) illumination pattern. Receiving illumination pattern information may include receiving an illumination pattern information that specifies an instruction to control the solid-state light emitter driver to drive each of the N independently controllable driver channels so that each of the plurality of solid-state light emitters of at least one of the N solid-state light emitter arrays are disabled. Receiving illumination pattern information may include receiving illumination pattern information from the external processor-based system over at least one radio or microwave frequency channel. Receiving illumination pattern information may include receiving illumination pattern information from the external processor-based system over at least one of a short-range wireless channel or a wired communications channel. Receiving illumination pattern information may include receiving illumination pattern information from the external processor-based system through at least one power-line power distribution system. Receiving illumination pattern information may include receiving illumination pattern information from at least one of a smartphone, a tablet computer, or a notebook computer. Receiving illumination pattern information may include receiving illumination pattern information from the external processor-based system over the at least one data communications channel, the illumination pattern information indicative of a notification illumination pattern to be produced by the N solid-state light emitter arrays, the notification illumination pattern providing a notification to humans that view the luminaire when the plurality of solid-state light emitters are illuminated according to the notification illumination pattern.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn, are not necessarily intended to convey any information regarding the actual shape of the particular elements, and may have been solely selected for ease of recognition in the drawings.

DETAILED DESCRIPTION

Figure 1:
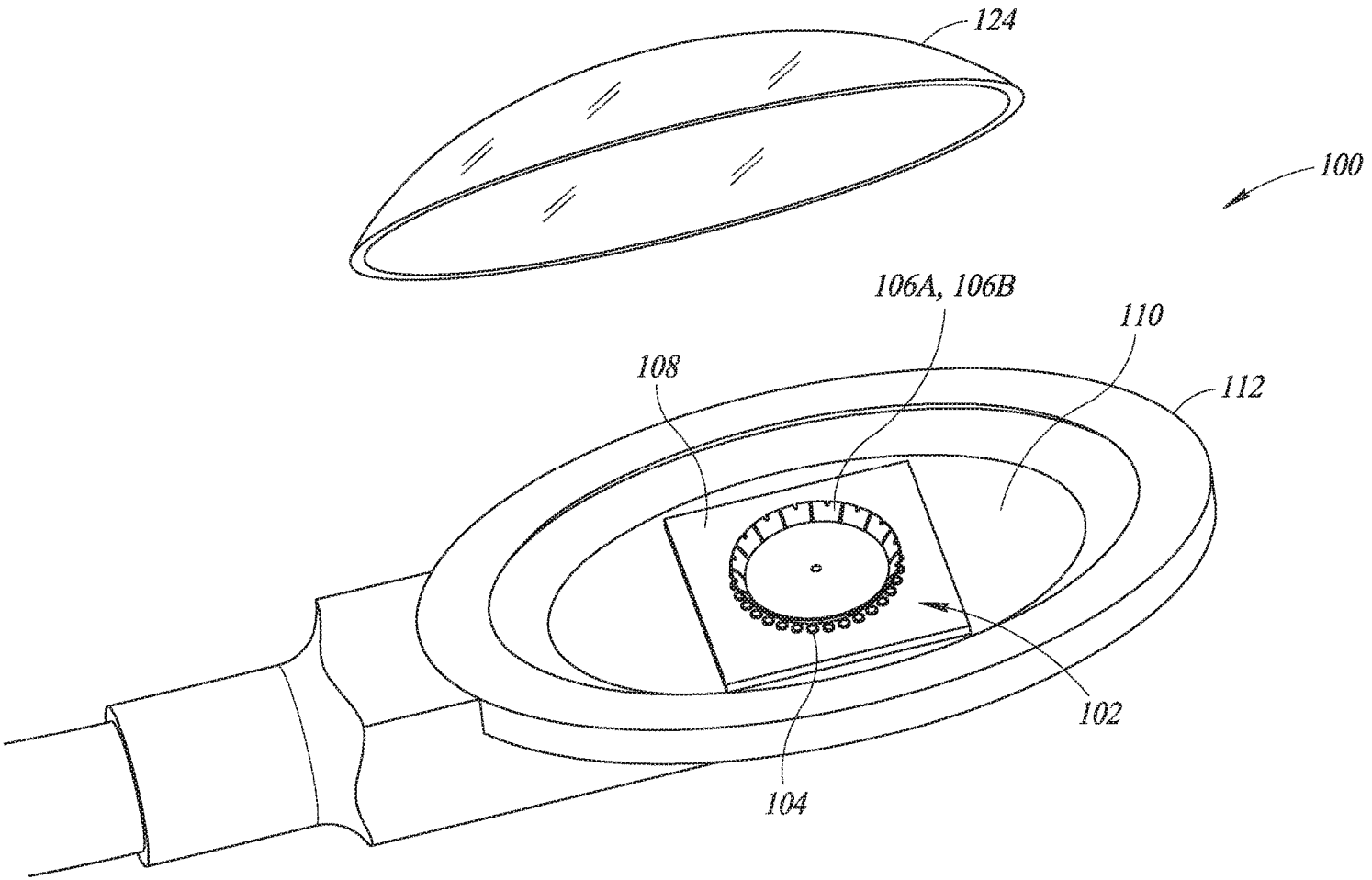
FIG. 1 is a bottom perspective view of a luminaire with a lens thereof separated from a housing of the luminaire, according to at least one illustrated implementation.

In the following description, certain specific details are set forth in order to provide a thorough understanding of various disclosed implementations. However, one skilled in the relevant art will recognize that implementations may be practiced without one or more of these specific details, or with other methods, components, materials, etc. In other instances, well-known structures associated with computer systems, server computers, and/or communications networks have not been shown or described in detail to avoid unnecessarily obscuring descriptions of the implementations.

Unless the context requires otherwise, throughout the specification and claims that follow, the word "comprising" is synonymous with "including," and is inclusive or open-ended (i.e., does not exclude additional, unrecited elements or method acts).

Reference throughout this specification to "one implementation" or "an implementation" means that a particular feature, structure or characteristic described in connection with the implementation is included in at least one implementation. Thus, the appearances of the phrases "in one implementation" or "in an implementation" in various places throughout this specification are not necessarily all referring to the same implementation. Furthermore, the particular features, structures, or characteristics may be combined in any suitable manner in one or more implementations.

As used in this specification and the appended claims, the singular forms "a," "an," and "the" include plural referents unless the context clearly dictates otherwise. It should also be noted that the term "or" is generally employed in its sense including "and/or" unless the context clearly dictates otherwise.

The headings and Abstract of the Disclosure provided herein are for convenience only and do not interpret the scope or meaning of the implementations.

Described herein are apparatus and method for minimizing or eliminating undesirable light while enhancing desirable light of solid state lighting sources without causing significant losses in energy and light output.

LED luminaires using phosphor based LEDs may emit wavelengths of light that are not desired or are potentially harmful to wildlife. Previous designs have used either absorptive or reflective filters to remove the undesired wavelengths, particularly wavelengths from 400 nm to 500 nm, for example. One or more implementations of the present disclosure utilize one or more transmissive filters which transmit short wavelength light instead of reflecting or absorbing the short wavelength light. In some implementations of the present disclosure, longer wavelength light, for example light with wavelengths longer than 470 nm, is reflected out of the luminaire by the transmissive filter in such a way as to form any of a number of illumination patterns, such as the NEMA standard light patterns (e.g., NEMA 5 circular pattern).

Light having wavelengths shorter than the transmissive filter's cut-off wavelength (e.g., 470 nm) is transmitted through the transmissive filter. These transmitted wavelengths may be absorbed by a wavelength shifter. Such wavelength shifter may comprise a phosphor material, such as acrylic plastic resin loaded with inorganic phosphor particles, placed on an output side of the transmissive filter. The phosphor material shifts the wavelength of the short wavelength light to a longer and more desirable wavelength which is then emitted from an optical exit of the luminaire. In this way, an energy gain is achieved compared to an absorption filter which dissipates the short wavelength light energy as heat.

In some implementations, systems and methods are provided which eliminate or reduce the need for a utility or luminaire distributer to stock luminaires with different illumination patterns and reduce or eliminate the need for pre-planning installations. Further, one or more implementations may allow for adjusting illumination patterns of luminaires wirelessly from the ground or from a central location using a supervisory control and data acquisition (SCADA) system, and provide for a wider variety of illumination patterns than the standardized patterns. Such adjustments may be made in response to customer complaints about a particular lighting pattern or in response to a change in the area to be illuminated, for example.

In addition, one or more implementations of the present disclosure allow scheduled dimming of luminaires, dimming in defined physical directions and scheduled adjustment of light patterns. The luminaires of the present disclosure may provide different light color illumination, such as amber color, in defined zones which may be required in biologically sensitive areas or other applications. As another example, notifications, such as severe storm warning alerts, may be signaled to the public by turning on or flashing an amber colored or other colored LED arrays.

Generally, implementations of the present disclosure provide a solid-state luminaire that includes one or more arrays of one or more solid-state light sources (e.g., LEDs) each. The luminaires may include an LED driver that includes an output channel for each of the LED arrays and on/off and/or dimming control for each LED driver channel. The luminaires may also include a controller capable of adjusting the dimming level or on/off state of one or more of the driver channels, and a communications method (wired or wireless) or a physical input, such as a switch, which sets dimming schedules and levels for each LED driver channel. The luminaires may further include support circuitry such as voltage surge suppression and electromagnetic interference (EMI) filtering, a housing and lens or cover window, and a photo sensor coupled to the controller for local "dusk to dawn" control of the light output. The luminaires may also include various hardware components for mounting the luminaires in the field.

Light emitted from LEDs of the LED arrays may be directed by the physical position of each of the LED arrays in the luminaire, and/or by reflective, refractive or diffractive optics, such that different areas may be illuminated when a respective LED driver channel is enabled or the dimming value of the LED driver channel is changed. The areas illuminated by the individual LED arrays may overlap partially or completely, or may be separate.

In some implementations of the present disclosure, the communications method is via a power line carrier (PLC) or a power line data communication system. In these implementations, decoupling and filtering circuits may extract data from power lines for use by PLC or power line data systems, and transmitters/drivers may insert data into a power line for communication over the power line. Such features are discussed in detail below.

In some implementations, the communications method is wireless control such as Bluetooth®, WiFi®, ZigBee®, or the like. In these implementations, the illumination pattern of a luminaire may be adjusted either in the field by use of a smart device or appliance, such as a smart phone, tablet computer or notebook computer, during installation and/or after installation. For example, if a customer has complained about light trespass, a minimally trained worker may be dispatched to the site, and may use a smart appliance to dim the light output on a side of one or more luminaires toward the area of trespass. Additionally or alternately, the light pattern of a luminaire may be adjusted at a central location prior to installation or after installation using the smart appliance or a computer with wired or wireless networking capabilities.

In some implementations, a luminaire may have four white light emitting LED arrays and a four-channel LED driver operative to enable/disable and/or dim the LEDs on the four respective LED arrays. As discussed further below, the LED arrays and optics may be arranged such that the LED arrays direct light toward the four ordinate directions from a luminaire's mounting axis. For example, if the mounting axis is perpendicular to a street, a first LED array may illuminate in the direction crossing the street, a second LED array may illuminate in the direction of a sidewalk/house, a third LED array may illuminate in one direction of the traffic flow, and a fourth LED array may illuminate in the other direction of traffic flow. By orienting the light output from the LED arrays in this manner, various light patterns (e.g., NEMA Type 1, NEMA Type 2, NEMA Type 3, NEMA Type 4, NEMA Type 5) may be substantially produced by the luminaire. In any of the produced illumination patterns, a portion of or the entire luminaire output may be dimmed by dimming one or more of the LED driver channels.

For example, a drive current or a pulse width modulated (PWM) duty cycle of each of the LED arrays may be set to substantially the same value, thereby setting the light output of each of the LED arrays to be substantially equal. In this example, equal light output of all the LED arrays of a luminaire may form a NEMA Type 5 light pattern on the ground. Alternatively, some of the LED arrays may be dimmed or turned off completely so that the luminaire generates other types of standardized or custom illumination patterns.

The luminaires of the present disclosure may be programmed to generate standard beam shapes such as Illuminating Engineering Society of North America (IESNA) or NEMA beam types as well as individually customized beam shapes, including shapes having uneven light distribution with added or subtracted amounts of light in small areas.

In some implementations, a diffuse window or lens placed over the LED arrays forms a weather shield and diffuses the LED light such that an aesthetically pleasing light pattern is formed, without visual "hot spots" or other objectionable irregularities in light output.

In another implementation, a luminaire may include a number (e.g., three) of LED arrays which are amber color emitting LED arrays positioned on a house facing side of the luminaire and the two street facing sides of the luminaire perpendicular to the mounting axis of the luminaire, and one white light emitting LED array on the street facing side of the luminaire. This implementation may be programmed by local wireless communications via a smart appliance for scheduled dimming, such that the white light emitting LED array may be turned off during a biologically sensitive season, for example, a sea turtle egg laying/hatching season. Additionally, in this example, the number of amber LED arrays may be dimmed during this season.

In some implementations, the multiple LED arrays may be assembled or carried on one printed circuit board (PCB) or may be assembled or carried on separate PCBs. For example, the LED arrays may be assembled on one or more flexible PCBs which may be attached to a mounting area on the luminaire by thermally conductive adhesive or other attachment method. The mounting area may be a flat plane, a raised polygon, a raised curved or cylindrical boss, or a convex and/or concave surface, for example. Light distribution for a particular illumination pattern may be made by selecting the appropriate shape of mounting surface during manufacturing of the luminaire. Further, one or more refractive, diffractive or reflective optical elements may be used to direct the light from the LED arrays to form the appropriate illumination pattern.

Figure 2:
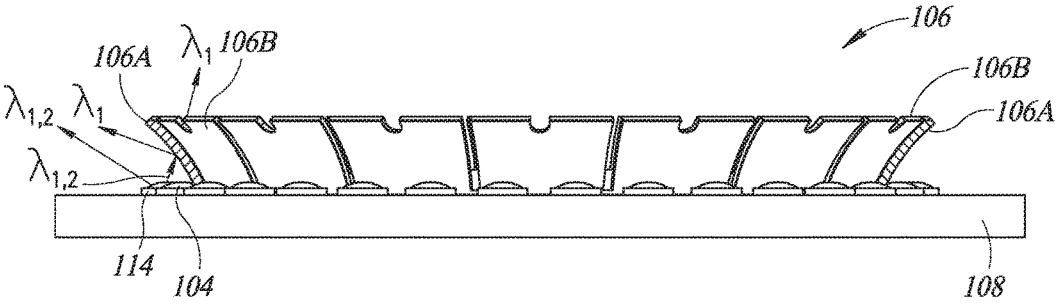
FIG. 2 is a side elevational view of the luminaire of FIG. 1 illustrating an array of light emitting diodes, a wavelength shifter, and a transmissive filter positioned to pass some wavelengths of light to the wavelength shifter while returning other wavelengths of light toward an optical exit of the luminaire, according to one illustrated implementation.
Figure 3:
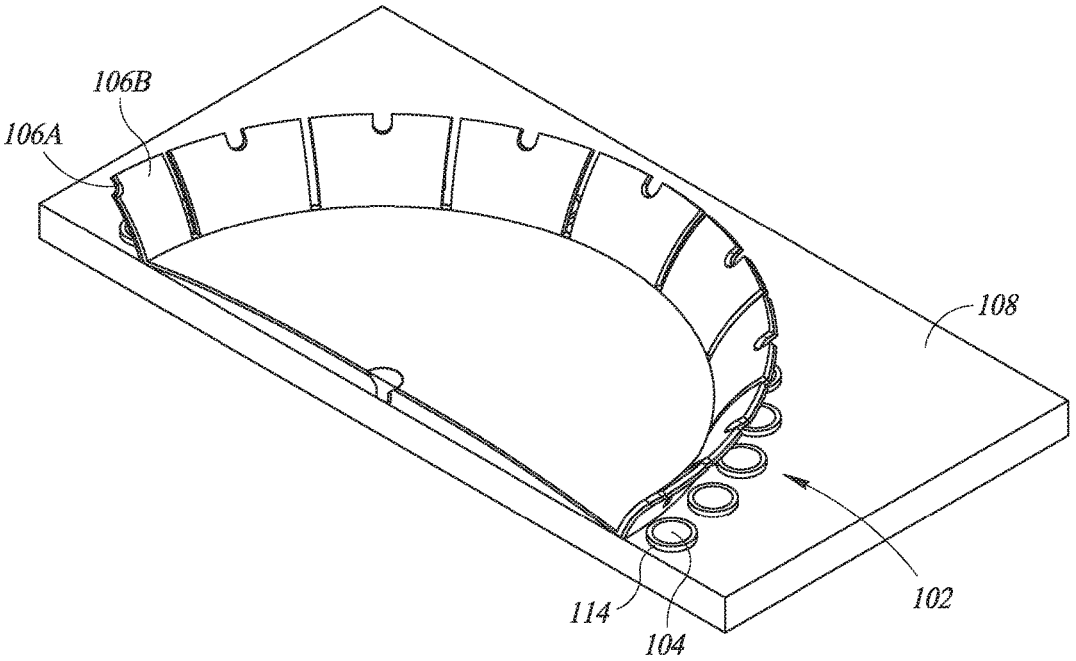
FIG. 3 is an isometric sectional view of the luminaire of FIG. 1, according to one illustrated implementation.
Figure 4:
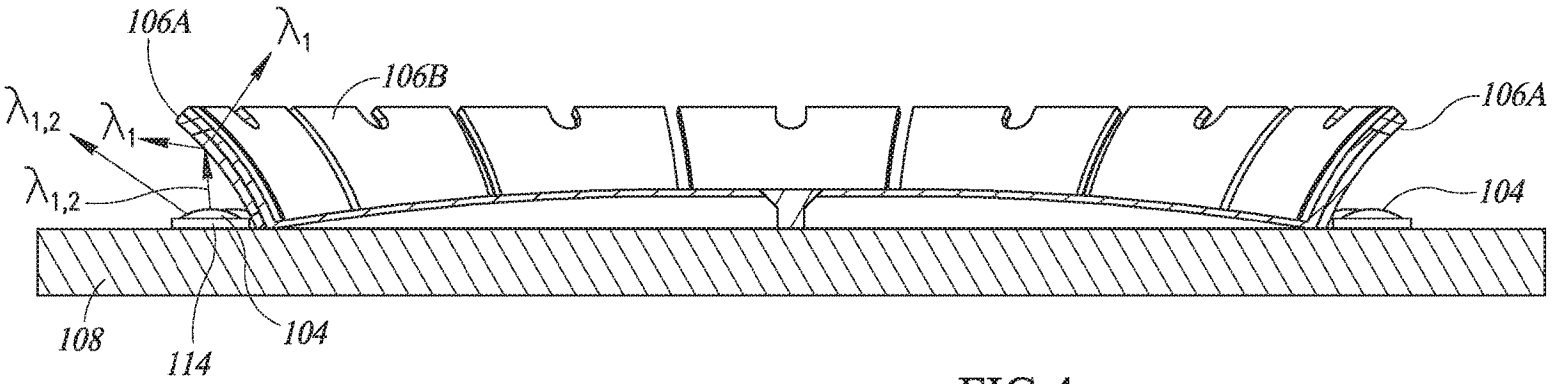
FIG. 4 is a side elevational sectional view of the luminaire of FIG. 1 illustrating light emitted from a light emitting diode which is partially transmitted by the transmissive filter toward the wavelength shifter and partially reflected by the transmissive filter toward the optical exit of the luminaire, according to one illustrated implementation.

FIGS. 1-4 show various views of an implementation of a luminaire 100 having an annular array 102 of LEDs 104 positioned around an annular component 106 comprising a transmissive filter 106A and a wavelength shifter 106B (FIG. 2). The LED array 102 may be assembled on a printed circuit board (PCB) 108, with thermally conductive adhesive used for both mounting and thermal interface to a heat exchanger (not shown) of the luminaire 100 that faces downward from an interior reflective surface 110 (FIG. 1) of a housing 112. The heat exchanger may be physically and thermally coupled to the housing 112 so that heat from the heat exchanger may be dissipated through the housing. In some implementations, such as the implementations shown in FIGS. 9 and 10 and discussed below, the printed circuit board may comprise a flexible circuit board "wrapped" around a heat exchanger or otherwise coupled to the housing.

The PCB 108 may form part of the housing 112. The PCB 108 may carry circuitry (not shown) to supply electrical power to the LEDs 104, for instance power regulator, rectifier, voltage converter or other circuitry. Electrical power may be supplied from an electrical power source such as voltage source V. The voltage source V may be a direct current source, such as a battery, or it may be an alternating current source, such as grid power or a common household electrical outlet. Examples of alternating current sources that may be used to supply electrical power to the circuitry of the PCB 108 include interior or exterior power from a home, interior or exterior power from a commercial building, or power such as is generally routed to an outdoor light pole.

The LEDs 104 may be formed on a die or substrate 114. The die or substrate 114 may be physically mounted to PCB 108 and electrically coupled to circuitry carried by the PCB 108 to receive power for LEDs 104. The die or substrate 114 may, for example, be coupled to PCB 108 via ball grid array, wire bonding, or a combination of the two. The die or substrate 114 and PCB 108 may advantageously function as a heat sink for LEDs 104.

The LEDs 104 of the LED array 102 emit light at wavelengths which are above transmissive filter's cut-off wavelength (e.g., 470 nm), designated as $\lambda_1$ in the figures, and light at wavelengths which are below the transmissive filter's cut-off wavelength, designated $\lambda_2$ in the figures. The collective light emitted from the LEDs is designated as $\lambda_{1,2}$ in the figures. The LED array 102 is arranged such that the LEDs 104 direct some but not all light toward the transmissive filter 106A and some but not all light away from the transmissive filter such that a portion of the light from each of the LEDs 104 exits the luminaire 100 without striking the transmissive filter 106A.

A lens 124 (FIG. 1) may be mounted on the housing 112 for weather protection and light diffusion. The lens 124 is shown as being separated from the housing 112 for explanatory purposes. The lens 124 may be placed around the LED array 102 to protect the LEDs 104 from moisture or other physical damage, and to diffuse light generated by the LEDs so that the light has a pleasing appearance. The lens 124 may include refractive or diffractive properties which may be used to produce a desired light pattern. In addition, the lens 124 may be coated with a dielectric reflective coating that selectively reflects some wavelengths of light while transmitting other wavelengths of light.

In operation, the transmissive filter 106A transmits the short wavelength light 2 from the LEDs 104 onto the wavelength shifter 106B (e.g., phosphor element). The longer wavelength light $\lambda_1$ emitted by the LEDs 104 is reflected by the transmissive filter 106A and exits an optical exit of the luminaire 100 as part of the desired light pattern. The wavelength shifter 106B shifts the shorter wavelength light $\lambda_2$ to longer wavelength light $\lambda_1$, which is emitted from the luminaire 100 as the remaining part of the determined light pattern. Advantageously, in implementations of the present disclosure, some of the short wavelength light $\lambda_2$ is allowed to exit the luminaire 100 without being shifted so that the total light output has a substantially balanced spectrum which pleasing to view, but not overly "yellow" as it would be if all of the shorter wavelengths $\lambda_2$ were removed.

The wavelength shifter 106B may take the form of one or more layers of a wavelength shifting material positioned to shift a wavelength of at least some of the light emitted by the LEDs 104. For example, the wavelength shifter 106B may take the form one or more layers of a phosphor material. The wavelength shifter 106B may be a molded plastic component loaded with phosphor material, may be phosphor material coated onto the output side of the transmissive filter 106A, or may be a formed sheet of phosphor loaded plastic film or other method of positioning phosphor material at the output of the transmissive filter, for example. In some implementations, the wavelength shifter 106B or phosphor element comprises molded plastic (e.g., Shin-Etsu Chemical Co., LTD. P/N 228K-PM) with the transmissive filter 106A coated onto the LED-facing side surface of the wavelength shifter.

The transmissive filter 106A may be a dielectric coating applied to a substrate which is a short pass filter with a cutoff wavelength near the wavelength of the undesired light. The transmissive filter 106A may also be a band-pass filter with the longer cutoff wavelength near the wavelength of the undesired light. In either case, the transmissive filter 106A transmits a substantial portion of the short wavelength light $\lambda_2$ onto the wavelength shifter 106B for conversion to longer wavelength light $\lambda_1$.

As one of skill in the art will recognize, optical elements such as filters typically do not have very precise cut off values. Thus, the terms "substantially" and "approximately" are used herein to denote the inherent impreciseness of such optical elements. Generally, any optical element that is at least 80% effective within 25% of the denominated value will suffice, although in some implementations even lower efficiencies and wider ranges may be suitable. The light that is passed by the transmissive filter 106A propagates to and through the wavelength shifter 106B to the exterior of luminaire 100, and the light that is returned (e.g., reflected or remitted) propagates to the exterior of the luminaire 100 without passing through the wavelength shifter.

Suitable semiconductor materials (i.e., phosphors) may include: gallium arsenide (GaAs), aluminum gallium arsenide (AlGaAs), gallium arsenide phosphide (GaAsP), gallium arsenide indium phosphide (GaAsInP), gallium (III) phosphide (GaP), aluminum gallium indium phosphide (AlGaInP), indium gallium nitride (InGaN)/gallium (III) nitride (GaN), aluminum gallium phosphide (AlGaP), and/or zinc selenide (ZnSe). The selection of particular materials may be governed by the desired wavelength of the output.

Figure 5:
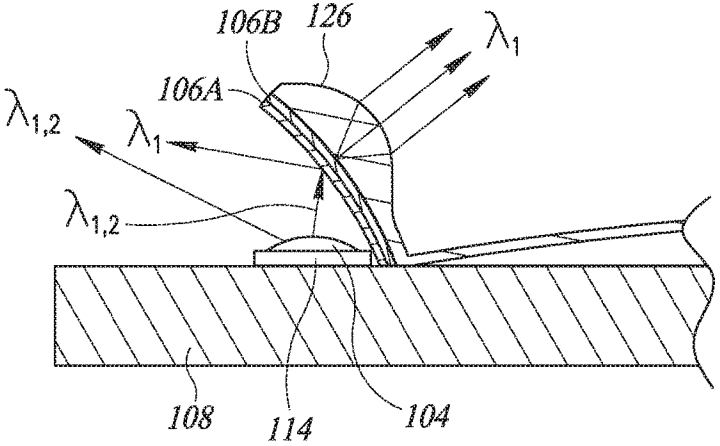
FIG. 5 is a side elevational sectional view of a luminaire illustrating a light emitting diode, a wavelength shifter, a transmissive filter, and a lens, the transmissive filter positioned to pass some wavelengths of light to the wavelength shifter and lends while returning other wavelengths of light toward an optical exit of the luminaire, according to one illustrated implementation.

FIG. 5 shows another implementation of the present disclosure wherein a refractive or diffractive lens element(s) 126 shapes the wavelength shifted light emission pattern such that the overall illumination pattern is relatively more desirable. The lens element(s) 126 may be molded from transparent plastic (e.g., acrylic, polycarbonate), for example. The lens element(s) 126 may be positive (convex), negative (concave), or both. In either case, the wavelength shifted light is gathered and emitted by the optical element(s) 126 such that a more desirable illumination pattern is realized, at higher efficiency due to the direction of wavelength shifted light in desirable directions and not undesirable directions such as towards other optical elements.

The wavelength shifter, transmissive filter, and/or lens elements may be of any number of shapes and sizes. In some implementations, one or more of such components may be disposed completely or nearly completely about a central or longitudinal axis, to form an annulus. In other implementations, one or more of the components may be formed by a plurality of rigid components disposed completely or nearly completely about a central or longitudinal axis, each constituting a respective facet of a polygonal annular shape or other shape (e.g., flower petal) about the central or longitudinal axis. In yet another implementation, one or more of such components may include a plurality of flexible or bendable components disposed completely or nearly completely about a central or longitudinal axis, each constituting a respective facet of a polygonal annular shape or other shape. Use of flexible or bendable components may reduce the total number of facets on the polygonal annular shape or other shape.

Thus, by upshifting a portion of the undesirable blue light (e.g., 400-490 nm), more pleasing and vibrant colors such as red and green wavelengths in the transmitted light are accentuated. Moreover, because the blue wavelengths of some of the light emitted from the LEDs 104 are transmitted to the wavelength shifter 106B, such wavelengths are shifted and emitted as respective longer wavelength light, thereby recycling the energy contained in the light transmitted through the transmissive filter 106A.

Figure 6:
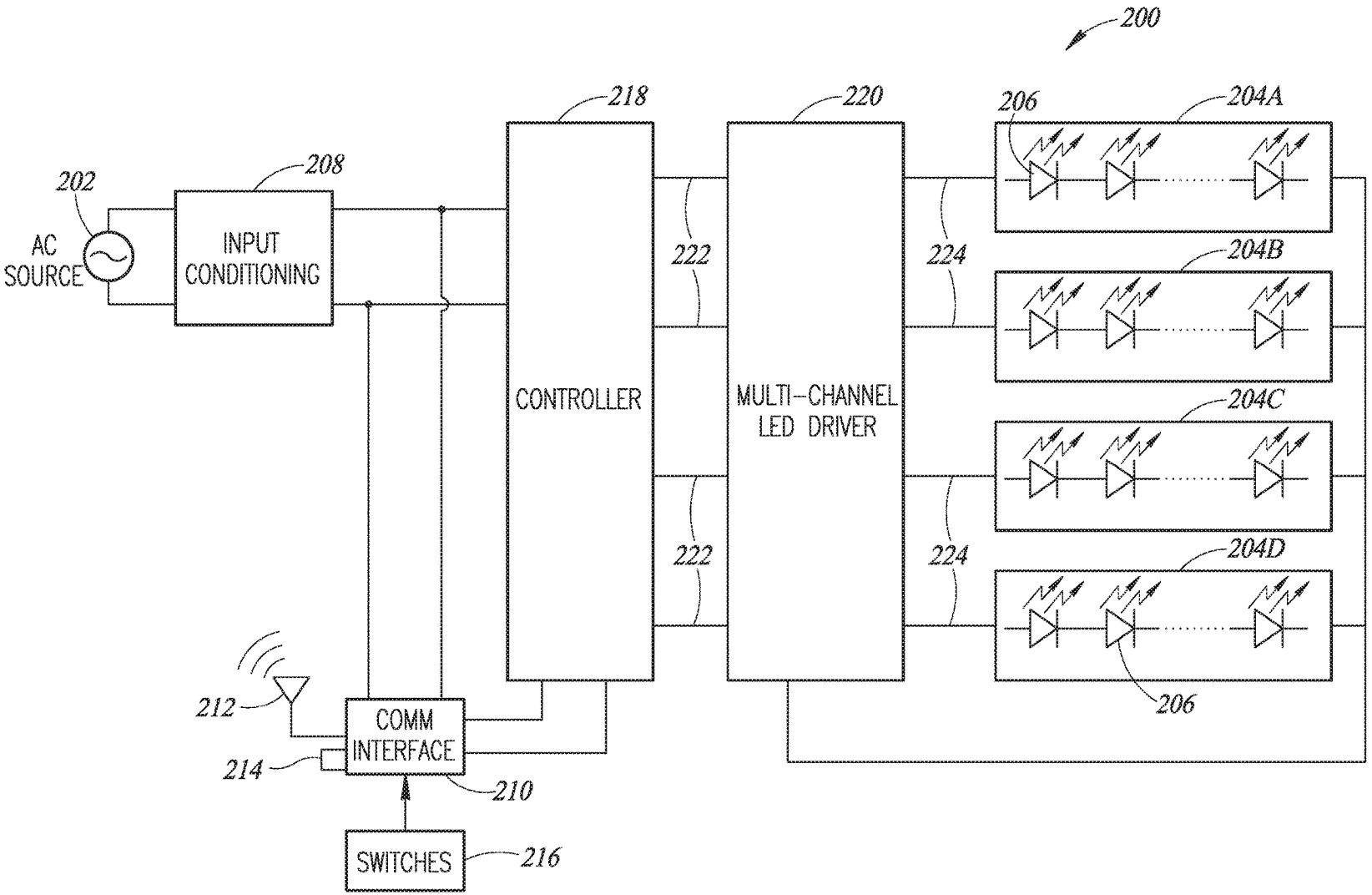
FIG. 6 is a schematic block diagram of a luminaire, according to at least one illustrated implementation.

FIG. 6 shows a schematic block diagram of a luminaire 200 coupled to an alternating current (AC) power source 202 in accordance with an implementation of the present disclosure. The luminaire 200 includes four LED arrays 204A-204D (collectively LED arrays 204) each including a plurality of LEDs 206. The luminaire 200 includes input conditioning circuitry 208 coupled to the AC power source 202 which may include voltage surge suppression devices, such as metal oxide varistors (MOV), electrical noise filtering circuitry, and/or over current protection circuitry.

The luminaire 200 may also include a communications interface or control input section 210 connected to a wireless input 212 (e.g., transceiver), a wired input 214 (e.g., universal serial bus (USB)), or a mechanical switch input 216 which are used to set or control the operational mode of the luminaire. The luminaire 200 may also include a controller 218 in the form of a processor-based microcontroller or other logic element or elements, as discussed further below.

The communications interface 210 may permit wireless communication, wired communication or other methods for controlling the brightness and/or other characteristics of the LEDs 206 of the LED arrays 204. For example, a "0 V to 10 V" dimming control may be incorporated. As another example, a Bluetooth® Smart wireless control may be provided. A photo control to switch the luminaire 200 on or off depending upon the natural ambient light may also be incorporated. A ZigBee® wireless interface may be used for communication between individual luminaires, or between a base station (not shown) and the luminaires, or between a smart appliance and the luminaires, to control the operation and/or other characteristics of the luminaires.

The luminaire 200 may also include a multichannel LED driver 220 operatively coupled to the controller 218. The LED driver 220 may take one of many forms, for example, a primary power converter followed by two or more individual drivers, or a primary power converter connected to two or more secondary output converters. As an example, the primary converter may be a power factor corrector (PFC) with a high voltage bus, for example a 450 VDC bus. In this example, the secondary converters may be Buck, Flyback, LLC Resonant, or any other switching power down-converter topology, for example. As another example, a non-switching power controller, such as a directly connected "AC LED," with a suitable semiconductor switch added to control output light level, may also be used.

One or more channels of the LED driver 220 may be adjustable by a signal or signals 222 provided by the controller 218 so that power delivered to the LED arrays 204 connected to the respective channels of the LED driver via wires 224 may be controlled, thereby changing the light output from a particular LED array. The signal or signals 222 may be a pulse width modulated (PWM) signal, a 0 V to 10 V analog signal, an $I^2C$ signal, or any other suitable control signal.

The channel power control for the LED driver 220 may be implemented, for example, by adjusting an analog current sink, an analog current source, a solid-state switch positioned in the low side or high side of the current path of each of the LED array 204, or by an integrated circuit input control of the controller 218, such as a "dimming input" or enable input. PWM dimming may also be used.

Dimming levels of each LED driver channel of the LED driver 220 may be adjusted by the controller 218 to set the illumination pattern for the luminaire. For example, a NEMA Type 5 illumination pattern may be obtained by setting all LED driver channels to the same drive current. If, for example, it is determined that the luminaire 200 causes an undesirable amount of light "trespass" for a residence located proximate the luminaire, the NEMA Type 5 lighting pattern may be modified by adjusting the light output of the LED driver channel that illuminates the "residence side" of the illumination pattern to output a lower level of light to decrease light "trespass" illumination of the residence.

Figure 7:
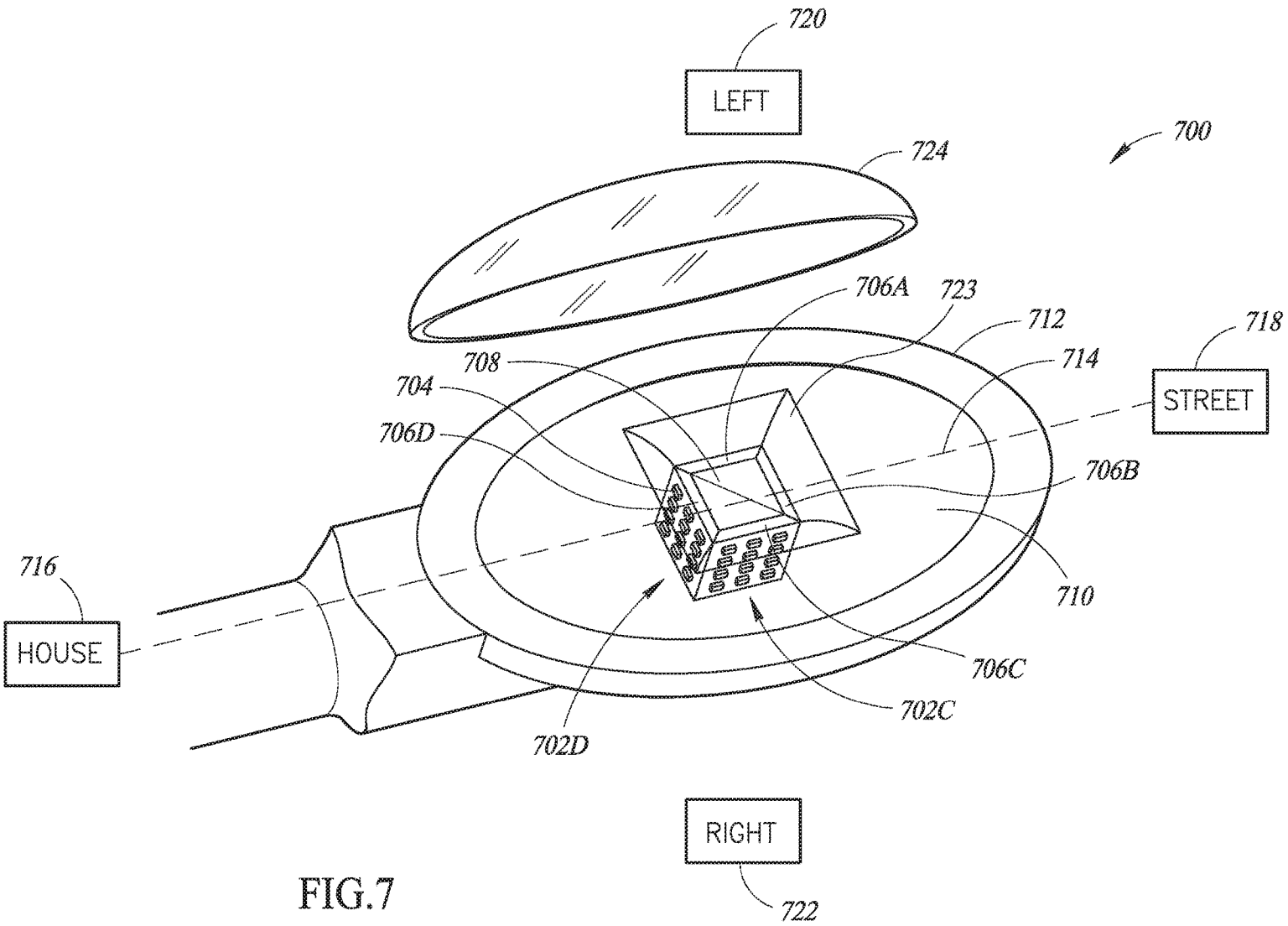
FIG. 7 is a bottom perspective view of a luminaire with a lens thereof separated from a housing of the luminaire, according to at least one illustrated implementation.
Figure 8:
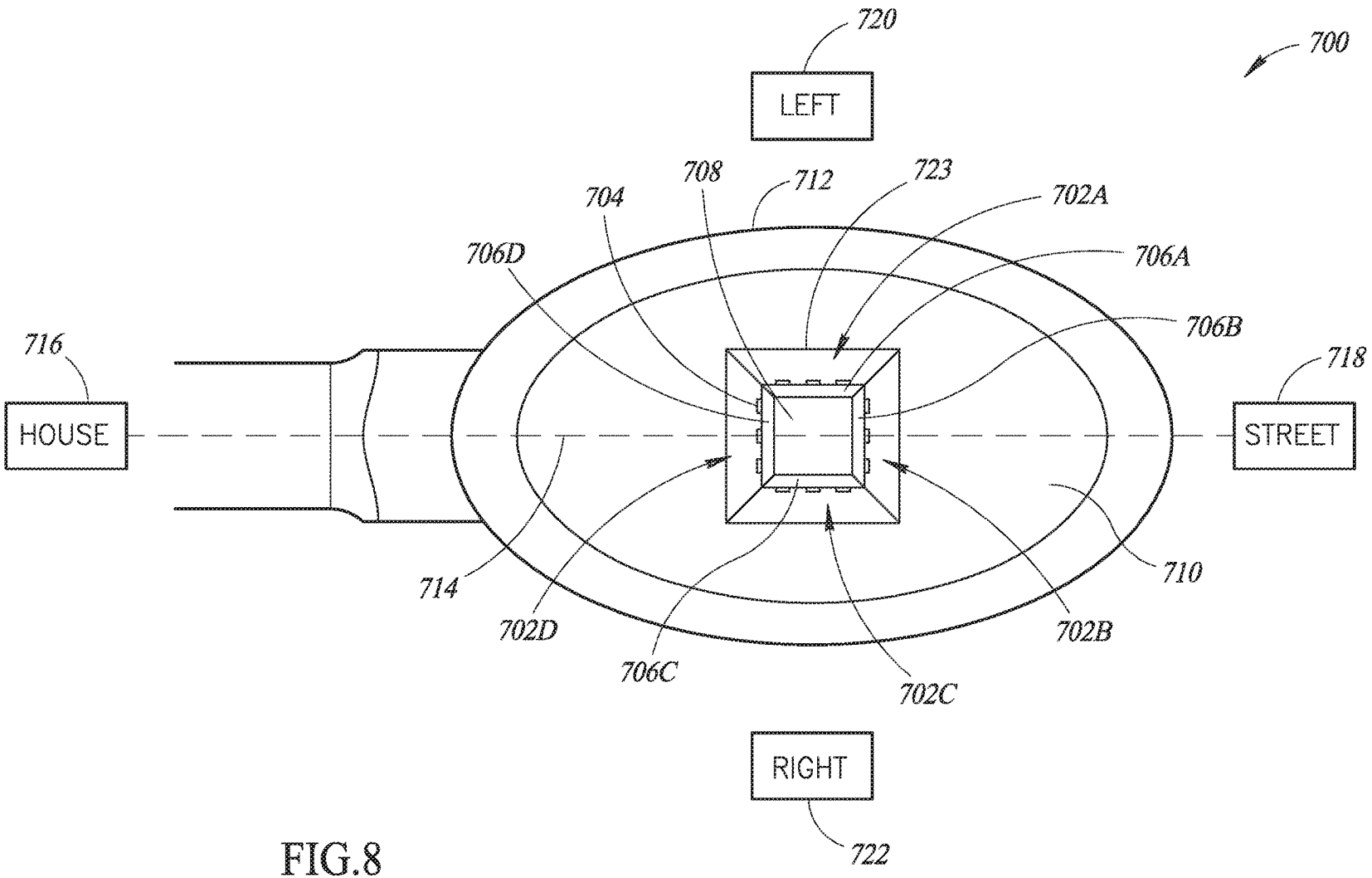
FIG. 8 is a bottom plan view of the luminaire of FIG. 7, according to at least one illustrated implementation.

FIGS. 7 and 8 show an implementation of a luminaire 700 having four LED arrays 702A-702D (FIG. 8), wherein each of the LED arrays have a plurality of LEDs 704. The LED arrays 702A-702D are assembled on four printed circuit boards 706A-706D, respectively, with thermally conductive adhesive used for both mounting and thermal interface to a cuboid shaped boss or heat exchanger 708 of the luminaire 700 that projects downward from an interior reflective surface 710 of a housing 712. The boss or heat exchanger 708 may be physically and thermally coupled to the housing 712 so that heat from the heat exchanger may be dissipated through the housing. In some implementations, the printed circuit boards 706 may comprise a single flexible circuit board "wrapped" around the heat exchanger 708. The LED arrays 702 are arranged such that the LEDs 704 direct light toward the four ordinate directions from a mounting axis 714 of the luminaire 700 that is perpendicular to a street when the luminaire is installed. The mounting axis 714 for the luminaire 700 is shown in FIGS. 7 and 8. Additionally, a house side 716, front street side 718, left street side 720, and a right street side 722 of the luminaire 700 are shown as per the NEMA outdoor light pattern standards.

A transmissive filter and wavelength shifter component 723 is positioned below the LED arrays 702A-702D such that a portion but not all of the light emitted from the LEDs 704 is imparted on the component 723. As discussed above with regard to FIGS. 1-5, the transmissive filter and wavelength shifter component 723 comprises a transmissive filter which transmits light below a determined wavelength (e.g., 470 nm) and reflects light above the determined wavelength. The light which is transmitted by the transmissive filter is received by a wavelength shifter of the component 723 and upshifted to a wavelength above the determined wavelength, as discussed above.

A lens 724 (FIG. 7) may be mounted on the housing 712 for weather protection and light diffusion. The lens 724 is shown as being separated from the housing 712 for explanatory purposes. The lens 724 may be placed around the LED arrays 702 to protect the LEDs 704 from moisture or other physical damage, and to diffuse light generated by the LEDs so that the light has a pleasing appearance. The lens 724 may include refractive or diffractive properties which may be used to produce a desired light pattern. In addition, the lens 724 may be coated with a dielectric reflective coating that selectively reflects some wavelengths of light while transmitting other wavelengths of light. In some implementations, there may be a reflective surface around the LEDs 704 that is coated with a wavelength converting phosphor that changes the color temperature of the emitted light in order to provide a more useful or pleasing appearance.

Figure 9:
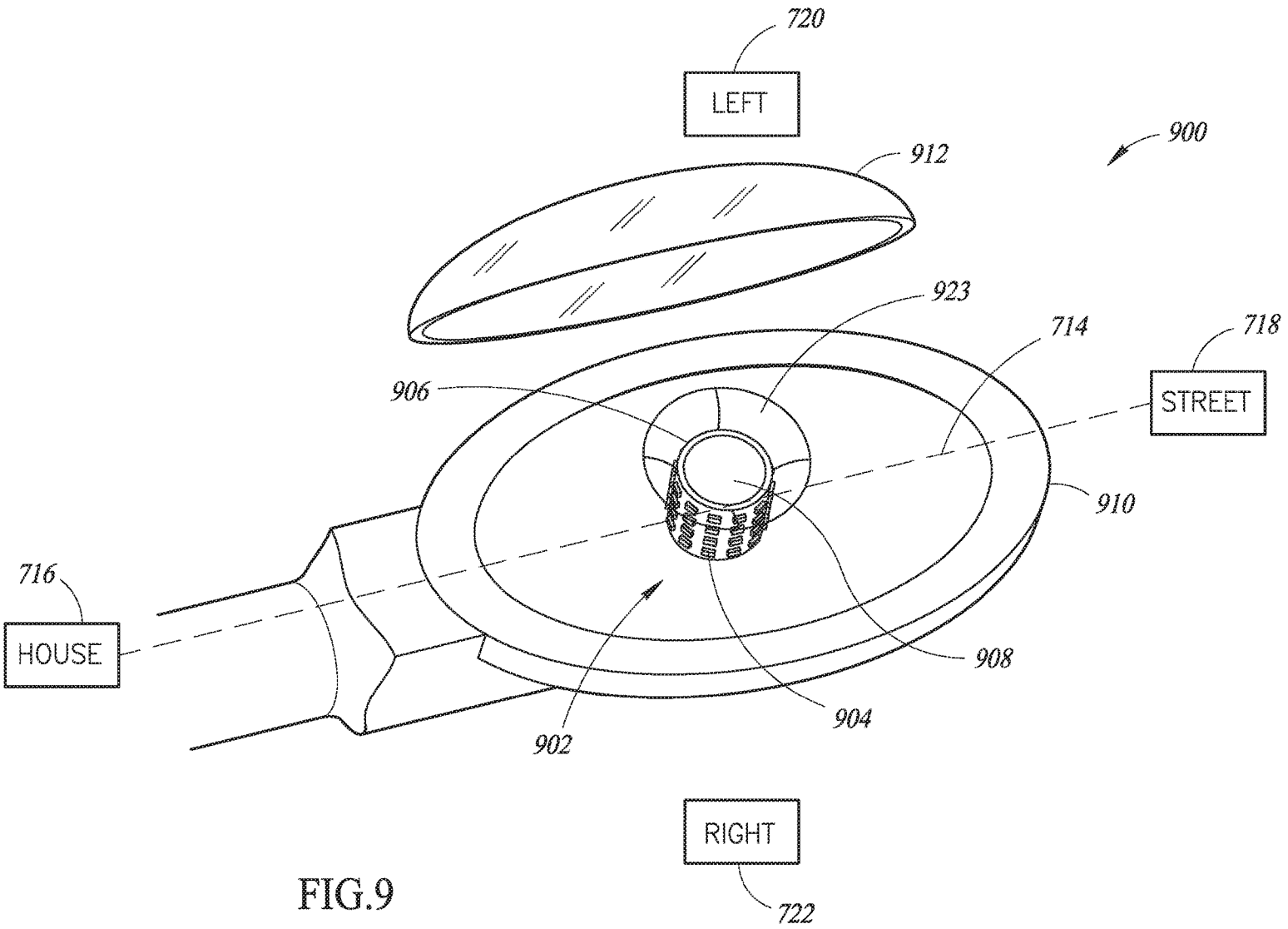
FIG. 9 is a bottom perspective view of a luminaire with a lens thereof separated from a housing of the luminaire, according to at least one illustrated implementation.
Figure 10:
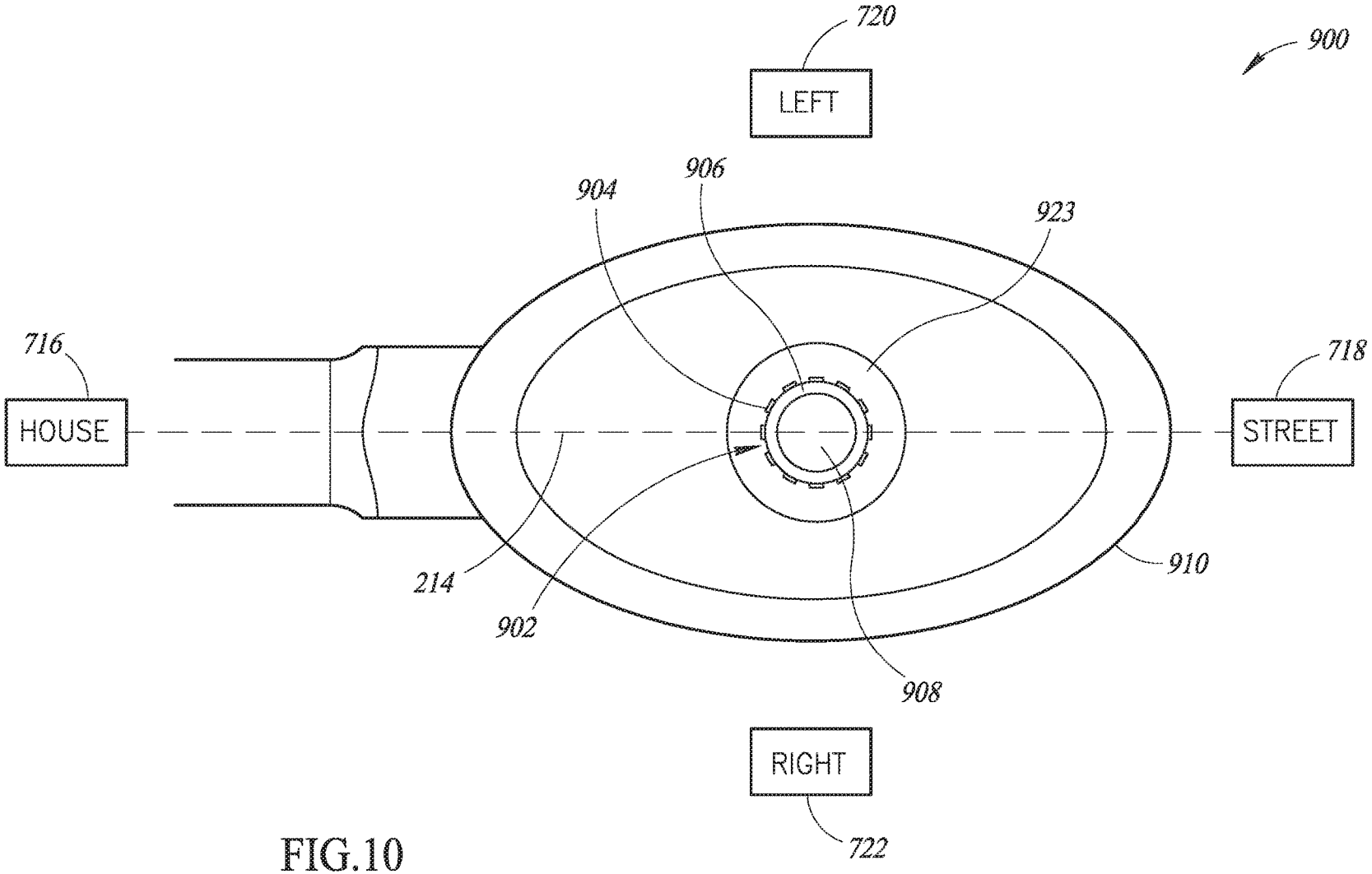
FIG. 10 is a bottom plan view of the luminaire of FIG. 9, according to at least one illustrated implementation.

FIGS. 9 and 10 show another implementation of a luminaire 900 that includes one or more LED arrays 902 each having a plurality of LEDs 904. The LED arrays 902 are positioned on a flexible circuit board 906 disposed around a cylindrically shaped boss or heat exchanger 908 positioned within an interior of a vessel collectively defined by a housing 910 and a lens 912 (FIG. 9). The plurality of LEDs 904 are carried by the circuit board 906 and arranged to generate light to pass through the lens 912 during operation. The LEDs 904 each have a respective principal axis of emission, which typically extends perpendicularly from an outer surface of the LEDs. In this implementation, the LEDs 904 are advantageously arrayed about a central or longitudinal axis, with their respective principal axes of emission extending radially outward from the central or longitudinal axis, for example in a 360° pattern.

In some implementations, the LEDs 904 may be grouped into a plurality of individually controllable LED arrays 902. For example, in the illustrated implementation the LEDs 904 are arranged in 12 vertical columns spaced about the central axis of the cylindrically shaped heat exchanger 908. In some implementations, each of the 12 columns may be individually controllable by a channel of an LED driver, such as the LED driver 120 shown in FIG. 6.

A transmissive filter and wavelength shifter component 923 is positioned below the LED arrays 902 such that a portion but not all of the light emitted from the LEDs 904 is imparted on the component 923. As discussed above with regard to FIGS. 1-5, the transmissive filter and wavelength shifter component 923 comprises a transmissive filter which transmits light below a determined wavelength (e.g., 470 nm) and reflects light above the determined wavelength. The light which is transmitted is received by a wavelength shifter of the component 923 and upshifted to a wavelength above the determined wavelength, as discussed above.

Figure 11:
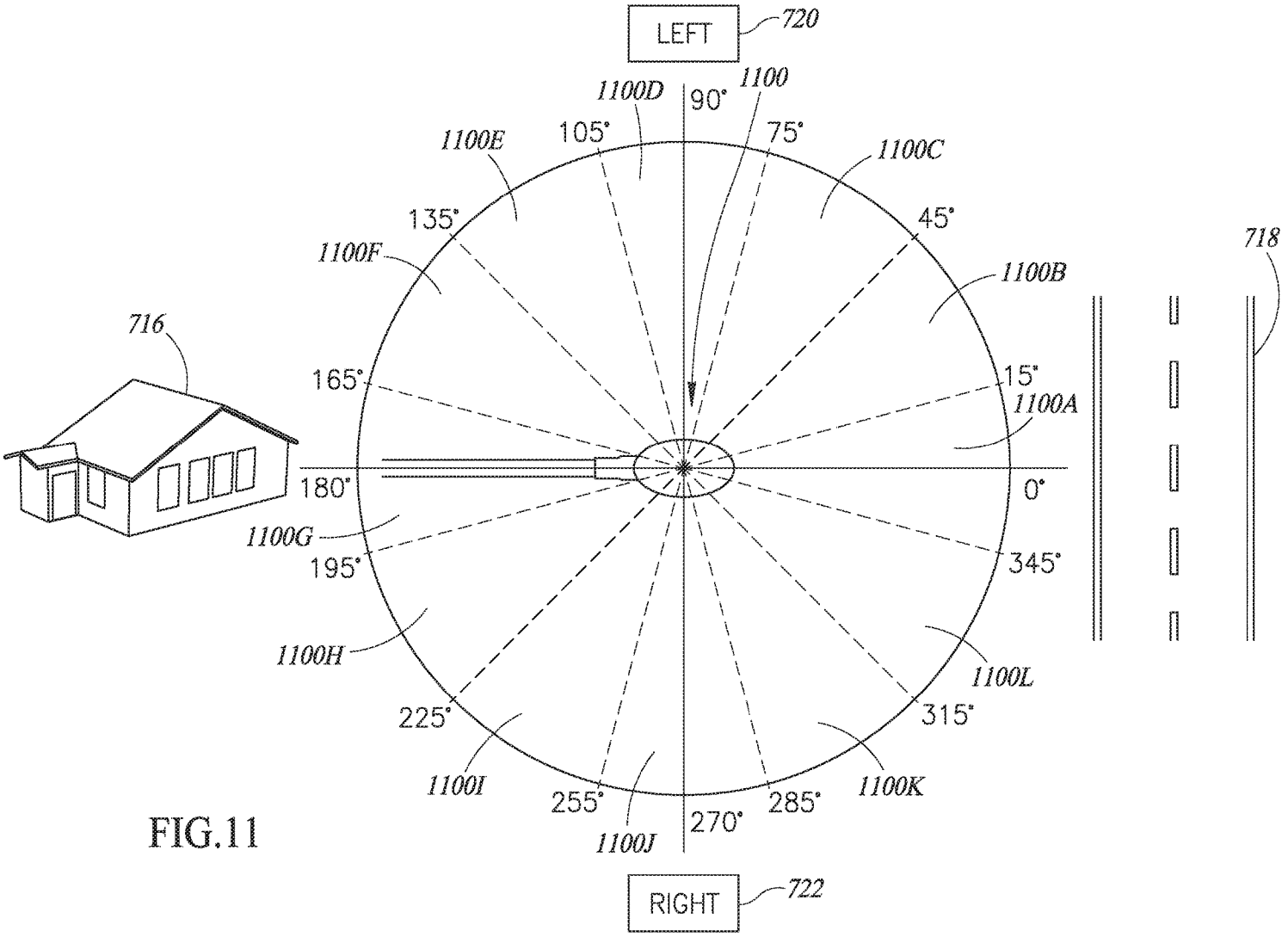
FIG. 11 is a top plan view of the luminaire of FIG. 9, showing an illumination pattern thereof, according to at least one illustrated implementation.
Figure 12A:
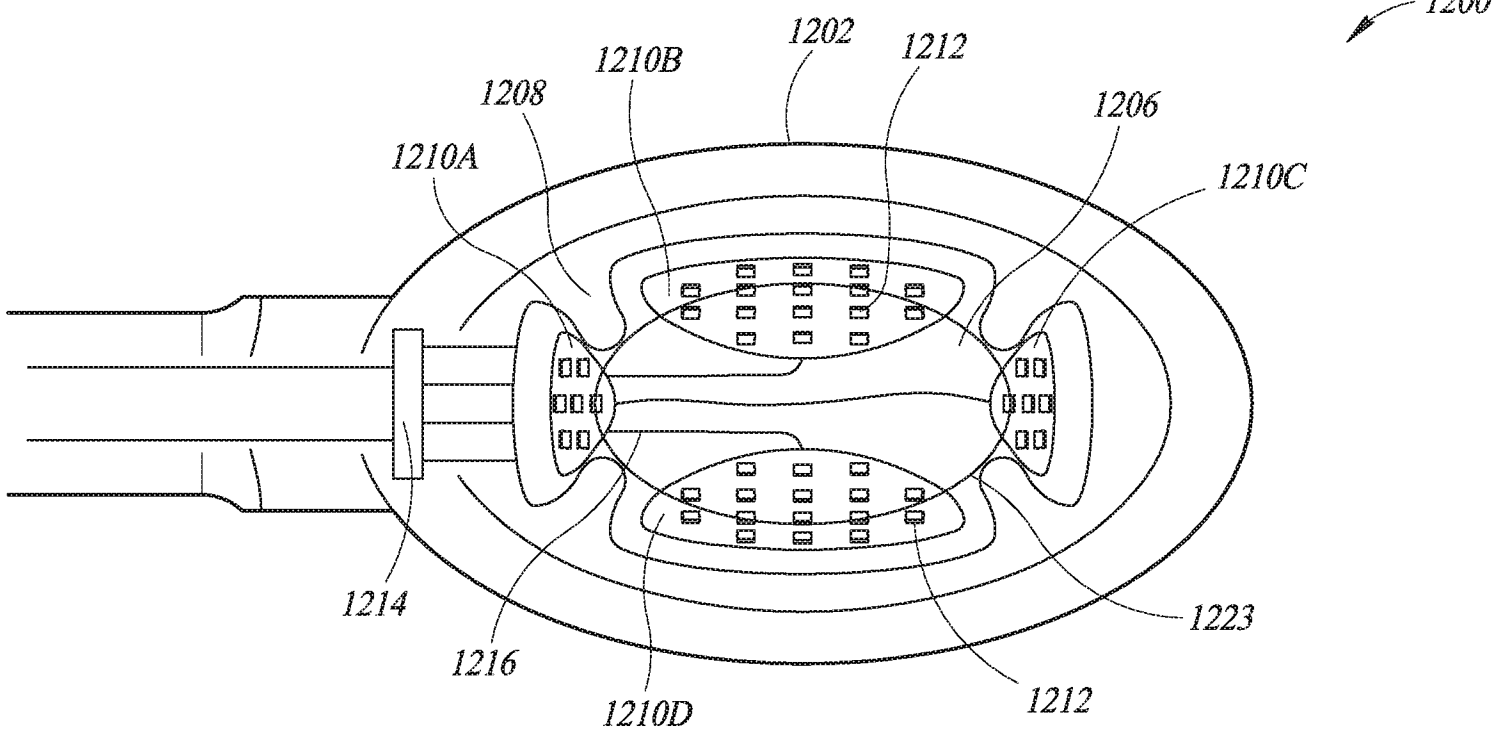
FIG. 12A is a bottom plan view of a luminaire, according to at least one illustrated implementation.
Figure 12B:
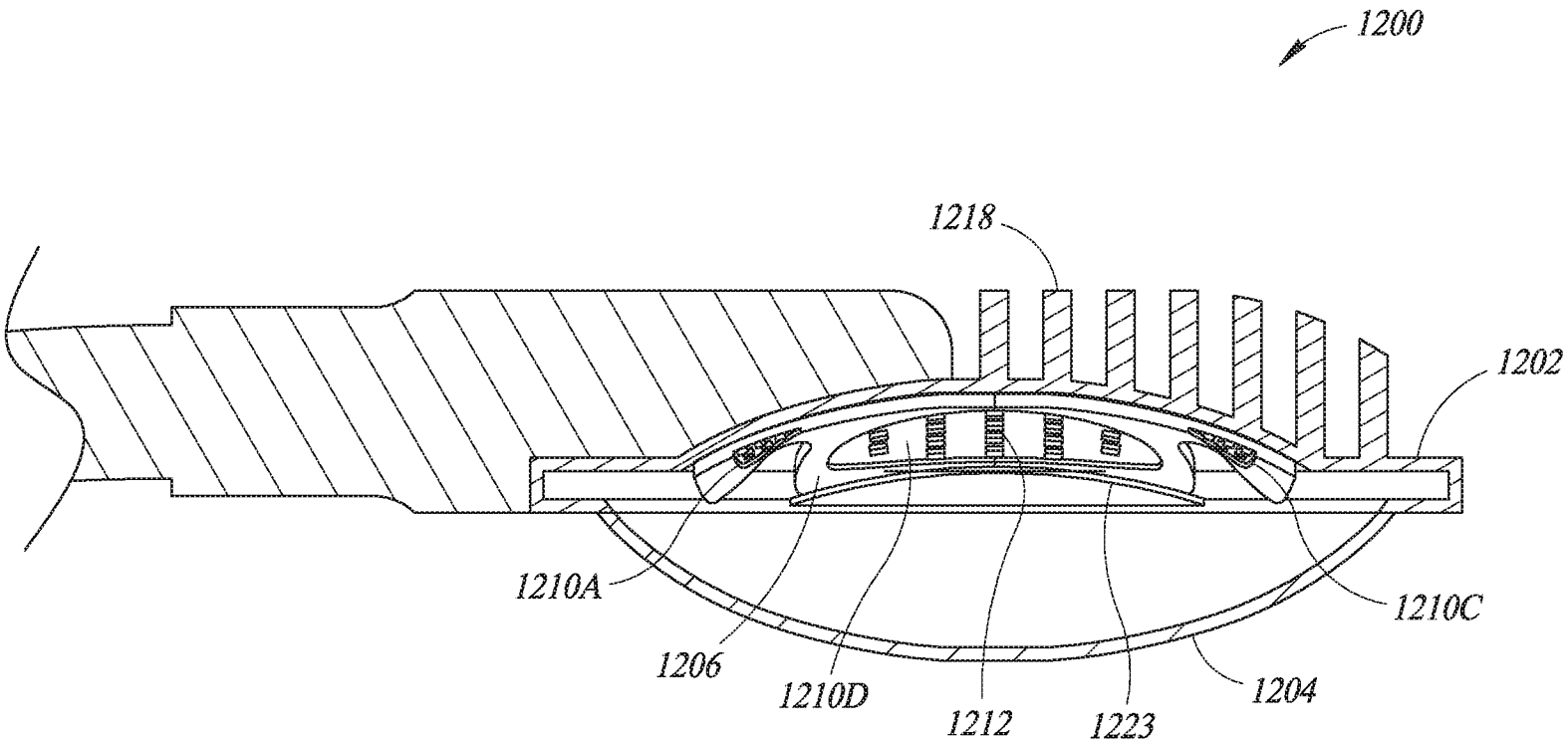
FIG. 12B is a right side elevational sectional view of the luminaire of FIG. 12A, according to at least one illustrated implementation.
Figure 13A:
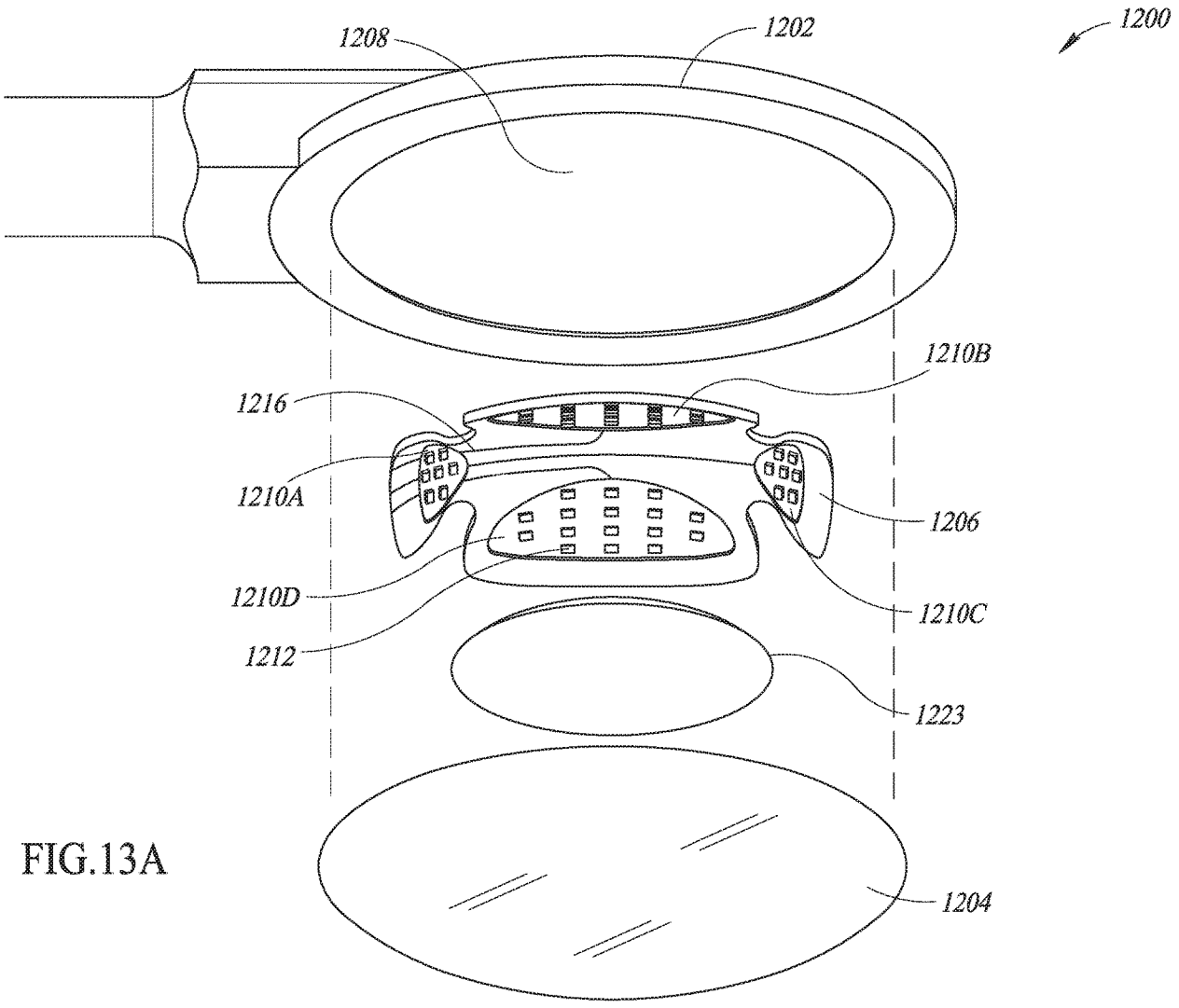
FIG. 13A is a partially exploded bottom perspective view of the luminaire of FIG. 12A, according to at least one illustrated implementation.
Figure 13B:
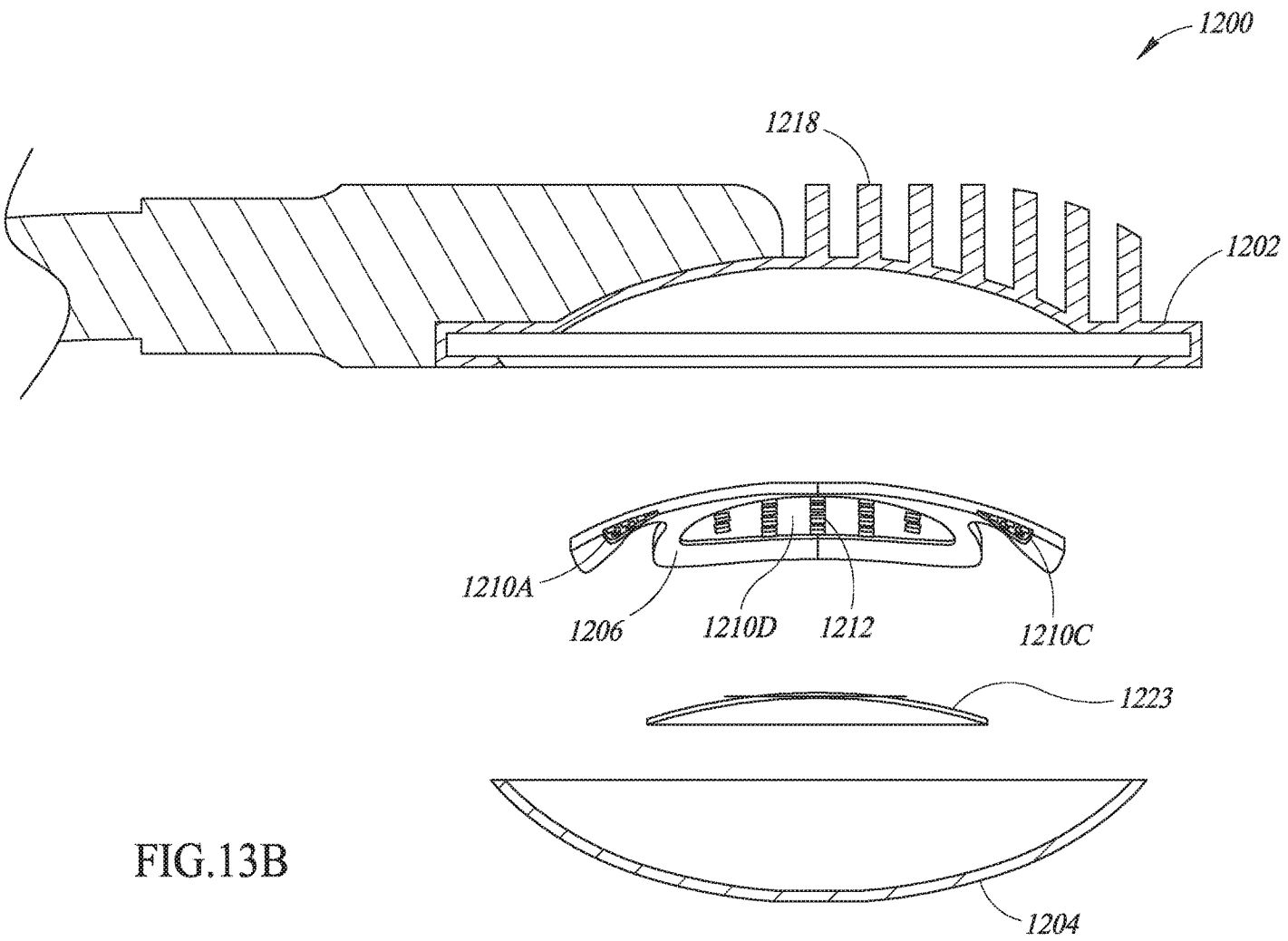
FIG. 13B is a partially exploded right side elevational sectional view of the luminaire of FIG. 12A, according to at least one illustrated implementation.

As shown in FIG. 11, each of the 12 LED arrays 902 may be used to control illumination in respective areas 1100A-1100L around the luminaire 900. In the illustrated implementation, each of the areas 1100A-1100L includes a 30° section of area around the luminaire 900. In practice, each of the areas 1100A-1100L may be overlapping or non-overlapping. Additionally, in some implementations the 12 LED arrays may be grouped into fewer or more individually controllable LED arrays 902. For example, in some implementations, the luminaire 900 may include four individually controllable LED arrays that each include three adjacent columns of the 12 columns of LEDs spaced about the heat exchanger 908. In such implementation, each LED array 902 may be used to control illumination over approximately a 90° section of area around the luminaire, similar to the luminaire of FIGS. 7 and 8.

The LEDs 904 may be mounted on the flexible or bendable printed circuit board 906 or may be mounted on individual rigid printed circuit boards and attached or secured to the heat exchanger 908 to dissipate heat generated by the LEDs 904. In some implementations, a single flexible or bendable printed circuit board may be disposed completely or nearly completely about a central or longitudinal axis, to form an annulus. In other implementations, a plurality of rigid printed circuit boards may be disposed completely or nearly completely about a central or longitudinal axis, each constituting a respective facet of a polygonal annular shape about the central or longitudinal axis. In yet another implementation, a plurality of flexible or bendable printed circuit boards may be disposed completely or nearly completely about a central or longitudinal axis, each constituting a respective facet of a polygonal annular shape. Use of flexible or bendable printed circuit boards may reduce the total number of facets on the polygonal annular shape. A thermal interface material, such as thermally conductive adhesive or grease, self-adhesive thermally conductive tape, or other such material may be placed between the heat exchanger and the printed circuit board to secure the printed circuit board to the heat exchanger and/or to increase heat conduction from the circuit board to the heat exchanger.

In other implementations, the LEDs 904 may be arranged in various other linear or non-linear arrangements. In some instances, greater quantities of low or mid power LEDs may be used in place of higher power (e.g., >1 watt) LEDs to make the collective light source more diffused and/or lower the manufacturing cost of the device. As an example, in some implementations, an array of LEDs may be provided on one or more flexible or bendable printed circuit boards having up to or more than 100 individual LEDs. The one or more circuit boards may be attached or secured to a heat exchanger, such as the heat exchanger 908 shown in FIGS. 9 and 10, to dissipate heat generated by the LEDs.

FIGS. 12A-12B and 13A-13B show another implementation of a luminaire 1200. The luminaire 1200 includes a housing 1202 and a lens 1204 that together form an interior vessel. The luminaire 1200 includes a flexible PCB 1206 coupled a downward facing mounting surface 1208 of the housing 1202 via a suitable adhesive, such as a thermally conductive pressure sensitive adhesive. The flexible PCB 1206 includes four LED arrays 1210A-1210D each having a plurality of LEDs 1212. Each of the LED arrays 1210 is coupled to a multi-channel LED driver 1214 via suitable electrical wires 1216. The multi-channel LED driver 1214 may be similar or identical to the LED driver 220 of FIG. 6 discussed above.

The housing 1202 functions as a heat exchanger for the LEDs 1212. As shown, the housing 1202 may include a plurality of fins 1218 (FIG. 12B), projections, surface treatment, or other features that increase the effective surface area of the housing to enhance its cooling capabilities. In some implementations, the housing 1202 may be coated with a nanoparticle surface treatment to increase thermal radiation from its surface.

The downward facing mounting surface 1208 of the housing 1202 may be concave shaped and the flexible PCB 1206 may be shaped during installation to match the shape of the mounting surface. In other embodiments, the mounting surface 1208 may be convex shaped, planar, or any combination thereof. The mounting surface 1208 may be faceted or may have a curvature with a constant radius or otherwise. Other implementations may use discrete PCBs wired together which are mounted to the mounting surface 1208 of the housing 1202, or a bendable metal core PCB which is bent or folded to conform to the mounting surface of the housing.

The shape of the mounting surface 1208 at least partially determines the illumination pattern of the luminaire 1200. For example, in implementations where the mounting surface 1208 has a relatively large degree of concavity, the illumination pattern is relatively narrow, whereas in implementations where the mounting surface has a relatively low small degree of concavity, the illumination pattern is relatively spread out. Thus, during manufacturing the shape of the mounting surface 1208 may be selected to provide a desired illumination pattern. Moreover, as discussed above, the illumination of each of the four LED arrays 1210A-1210D may be controlled individually, which allows for numerous illumination patterns for the luminaire 1200 after installation of the luminaire.

In the implementation illustrated in FIGS. 12A-12B and 13A-13B, the curved mounting surface 1208 is concave about multiple axes (e.g., a longitudinal axis and a lateral axis). In other implementations, the mounting surface 1208 may be concave about one or more axes (e.g., doubly concave) or may be convex about one or more axes.

The flexible or rigid circuit boards discussed herein may include one or more layers of an electrically insulative or dielectric material. Common materials include FR2, FR3, FR4, aluminum core (ThermaCore, Inc.; Bregquist, Inc.), or Kapton dielectric flexible circuit. The circuit boards may include one or more electrically conductive paths carried on one or more layers, or through one or more layers by vias or through holes. Electrically conductive paths may, for example, take the form of one or more traces of electrically conductive material. The circuit boards may take the form of a printed circuit board.

The housings and/or heat exchangers ("heat sinks") discussed herein may take a variety of forms suitable for transferring heat from a solid (e.g., solid-state light sources) to a fluid (i.e., gas or liquid). The heat exchangers may have a dissipation portion which typically includes a relatively large surface area, allowing dissipation of heat therefrom to a fluid (e.g., ambient environment) by convective and/or radiant heat transfer. The dissipation portion may, for example, include one or more protrusions. In some implementations, the protrusions may take the form of fins or pin fins. The heat exchangers may comprise a metal (e.g., aluminum, aluminum alloy, copper, copper alloy) or other high thermal conductivity material. The heat exchangers may, for example, have a thermal conductivity of at least 150 Watt per meter Kelvin (W/mK).

A transmissive filter and wavelength shifter component 1223 is positioned below the LED arrays 1210A-1210D such that a portion but not all of the light emitted from the LEDs 1212 is imparted on the component 1223. As discussed above with regard to FIGS. 1-5, the transmissive filter and wavelength shifter component 1223 comprises a transmissive filter which transmits light below a determined wavelength (e.g., 470 nm) and reflects light above the determined wavelength. The light which is transmitted by the transmissive filter is received by a wavelength shifter of the component 1223 and upshifted to a wavelength above the determined wavelength, as discussed above.

Figure 14:
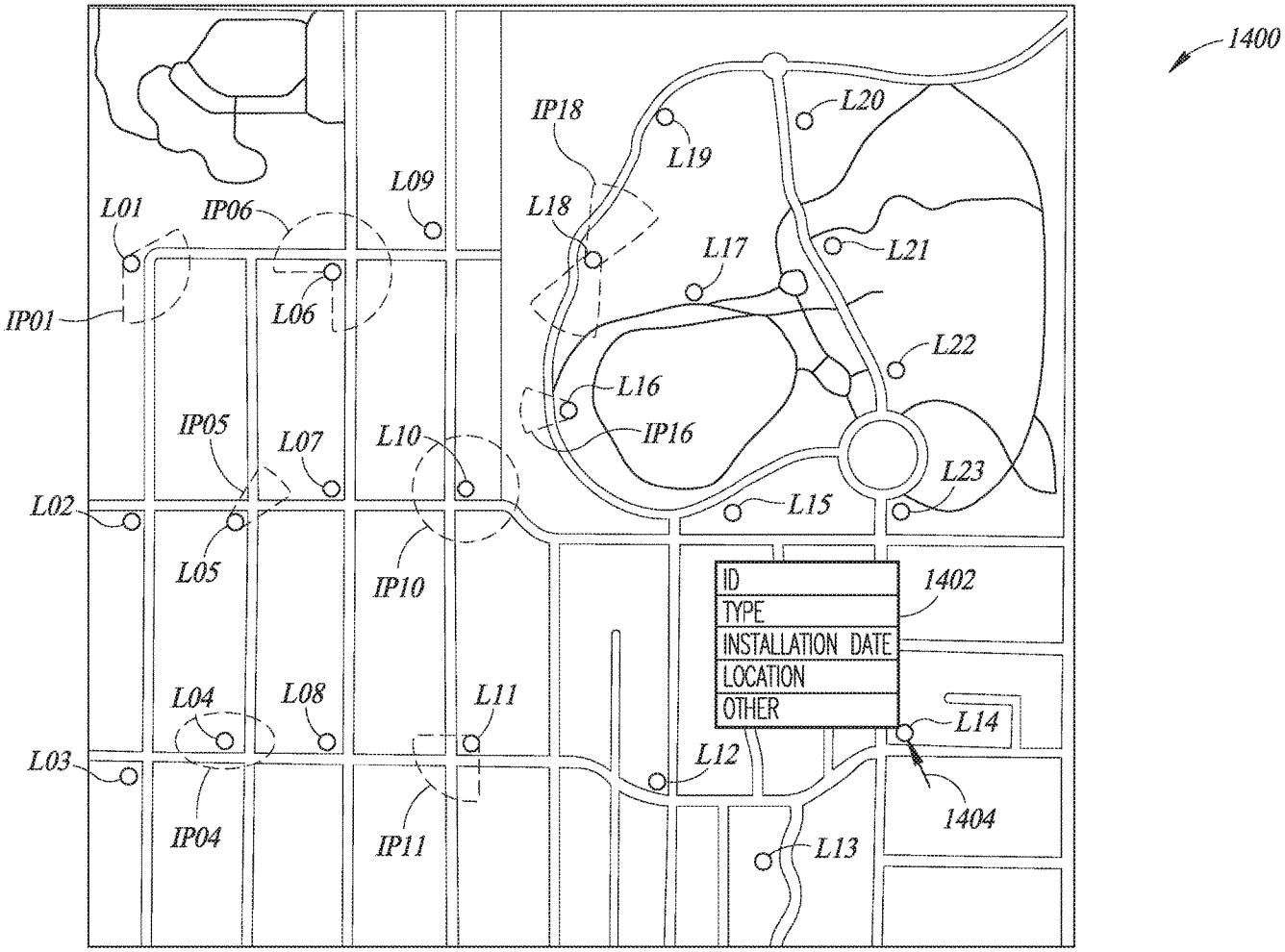
FIG. 14 is a luminaire management map depicting the locations of numerous luminaires, luminaire information for the luminaires, and illumination patterns for the luminaires, according to at least one illustrated implementation.

FIG. 14 illustrates a map 1400 that may be viewable by a processor-based device associated with an illumination system. The map 1400 depicts a plurality of icons L01-L23 for plurality of respective luminaires positioned at various locations throughout a geographical area (e.g., a city). The map 1400 may be displayed to a user on an output device (e.g., a monitor, touchscreen) of a computing device operative to receive data from the central asset management system.

The map 1400 may display a window 1402 that includes luminaire information for one or more luminaires of the illumination system. In the illustrated example, the window 1402 is a pop-up window that displays information for the luminaire depicted by the icon L14 when a cursor 1404 hovers over the icon. In other implementations, the window 1402 may be displayed when a user selects one of the icons L01-L23 using any suitable input selection method (e.g., touch, keyboard, manual entry).

The information provided in the map 1400 or window 1402 may be varied or configured as desired for a particular user or a particular application. For instance, a user may be interested in viewing only a particular subset of the luminaires in an illumination system. As non-limiting examples, a user may be interest in viewing only those luminaires that have an expected life of less than one year, only those luminaires that were installed within the past six months, or only those luminaires within a two-mile radius of a service depot. As another non-limiting example, the user may be interested in viewing only a subset of the luminaire information available for each luminaire, such as only the serial numbers of each of the luminaires.

For each of the luminaires L01, L04, L05, L06, L10, L11, L16 and L18, the map 1400 provides an illustration of respective illumination patterns IP01, IP04, IP05, IP06, IP10, IP11, IP16 and IP18 (collectively illumination patterns IP). The illumination patterns IP are patterns the luminaires that have been set by an operator, as discussed above. In some implementations, an operator may be able to select (e.g., touch, click on) one or more of the luminaires L01-L23 displayed on the map 1400, and selectively view or edit the illumination patterns of one or more of the luminaires.

Figure 15:
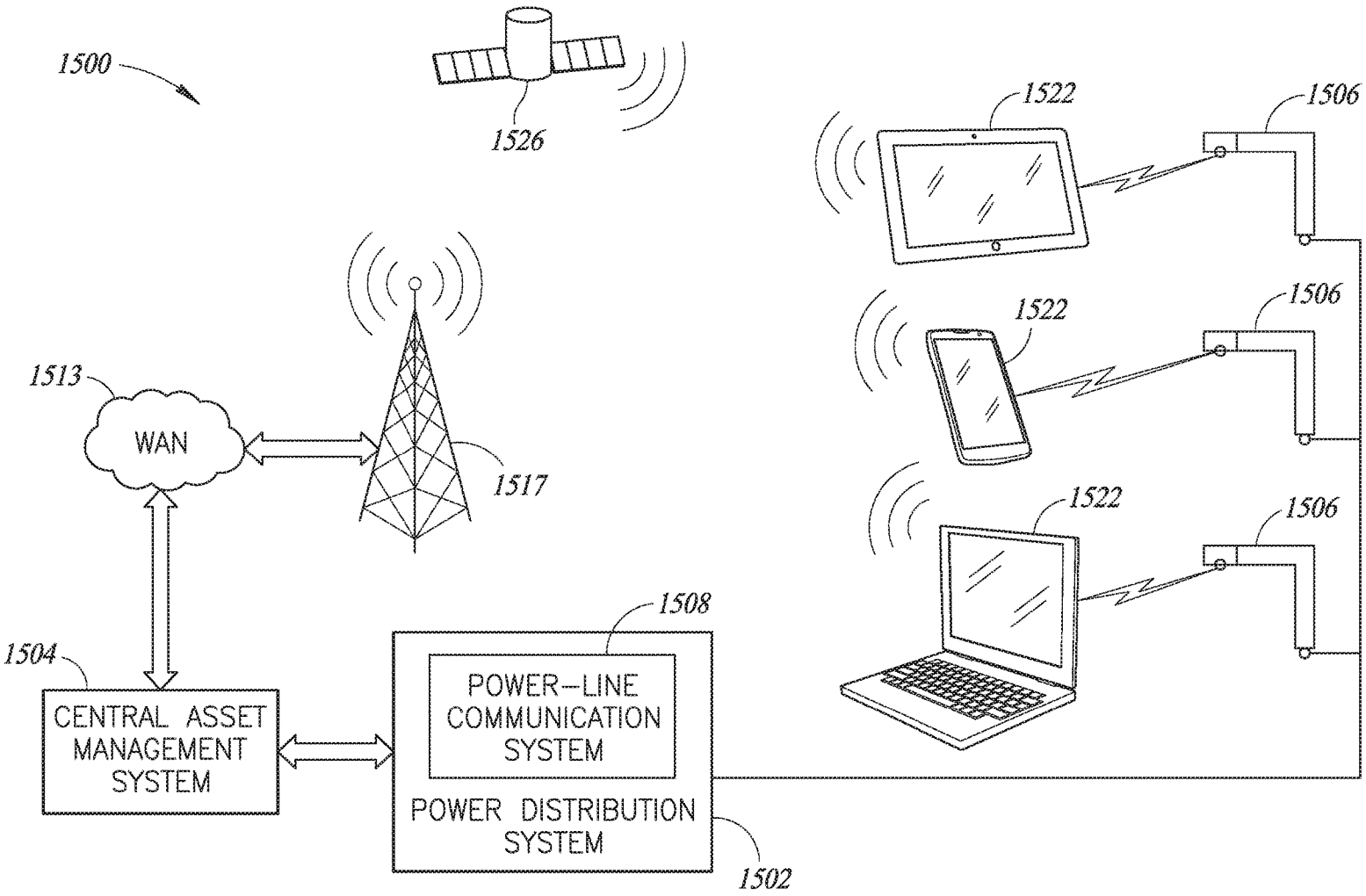
FIG. 15 is a schematic view of an environment in which a luminaire management system may be implemented, according to at least one illustrated implementation.
Figure 16:
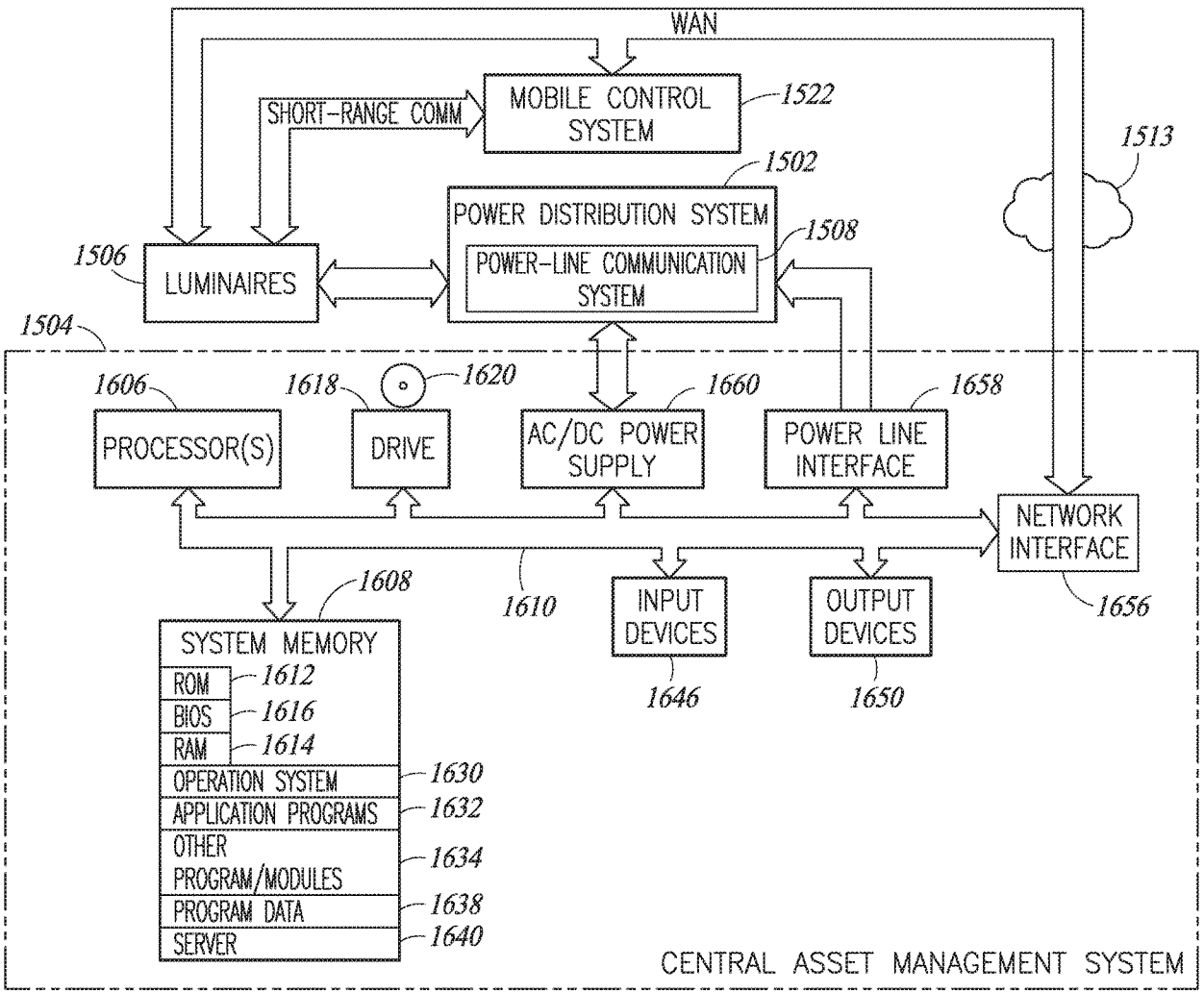
FIG. 16 is a functional block diagram of the luminaire management system of FIG. 15, according to at least one illustrated implementation.

FIG. 15 illustrates a schematic block diagram of an illumination system 1500 that includes a power distribution system 1502, such as an alternating current (AC) network (e.g., power grid or mains) of a utility that includes one or more AC power sources, a central asset management system 1504, a plurality of outdoor luminaires 1506, and mobile control systems 1522 positioned proximate each of the luminaires. The particular functional features of the central asset management system 1504 are shown in FIG. 16, and the particular functional figures of the luminaires 1506 and the mobile control systems 1522 are shown in FIG. 17.

Three luminaires 1506 are shown in FIG. 15, but it should be appreciated that the number of luminaires may vary depending on a particular application. For example, for applications wherein the luminaires 1506 are part of an illumination system for a city, the number of luminaires may be in the hundreds or even thousands. As discussed further below, the central asset management system 1504 and the plurality of luminaires 1506 are communicatively coupled to a power-line communication system 1508 of the power distribution system 1502 to facilitate communications between the central asset management system and the plurality of luminaires via power lines of the power distribution system. In some implementations, the central asset management system 1504 may additionally or alternatively communicate with the plurality of luminaires 1506 via other types of networks or channels, such as one or more wired and/or wireless communications networks 1513. In the illustrated implementation, the luminaires 1506 may wirelessly communicate with an access point 1517 (e.g., cellular tower, WIFI® access point) operatively coupled to the one or more communication networks 1513.

Figure 17:
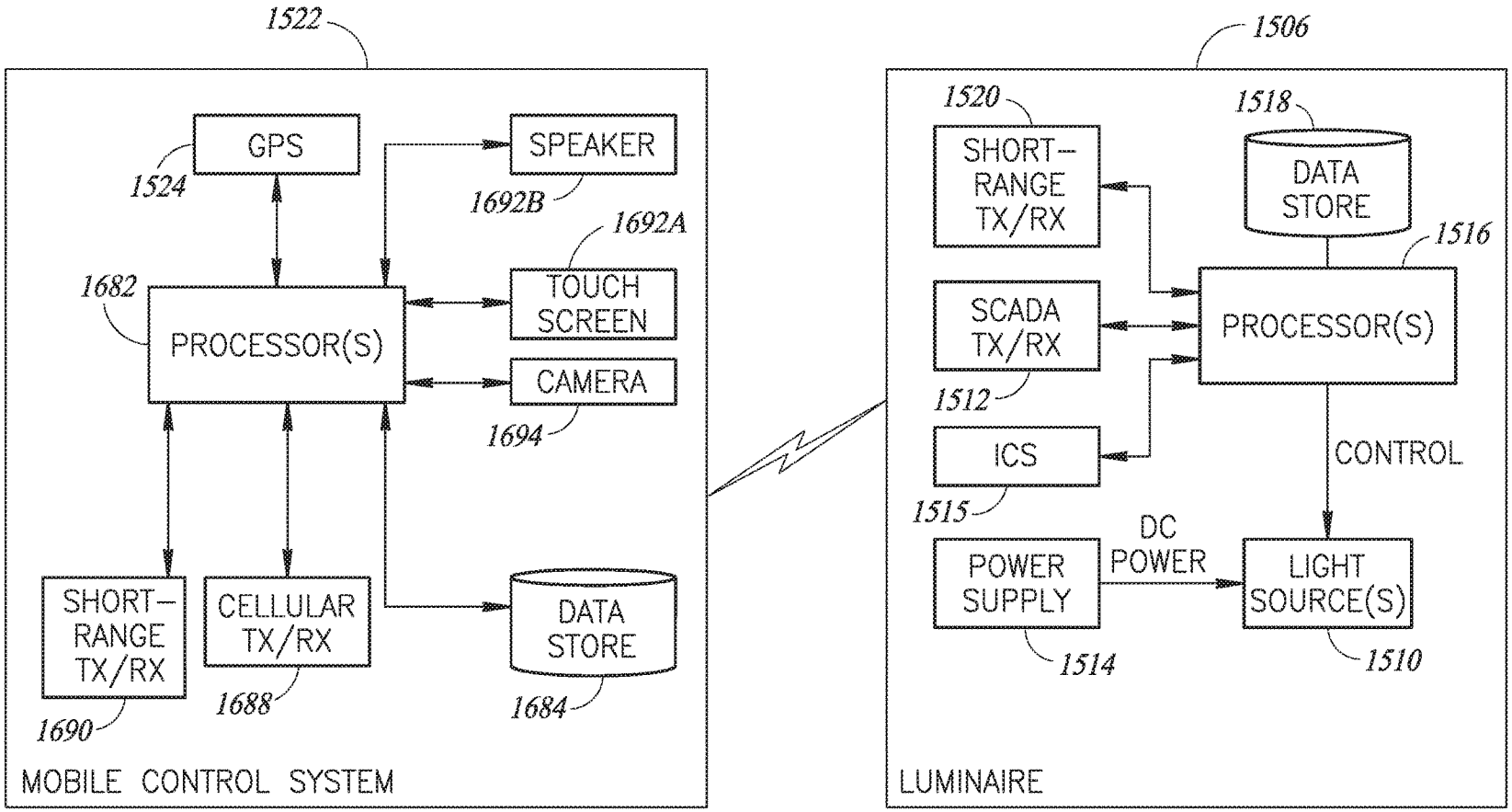
FIG. 17 is a functional block diagram of a mobile control system and a luminaire associated with the luminaire management system of FIG. 15, according to at least one illustrated implementation.

As shown in FIG. 17, each luminaire 1506 includes one or more light sources 1510, a power-line transceiver 1512 (or other wired/wireless transceiver(s)), a power supply 1514, a local illumination control system (ICS) 1515, a luminaire processor 1516, a nontransitory data store 1518, and one or more wired/wireless short-range communications transceivers 1520 (e.g., Bluetooth®, Wi-Fi®, USB®).

The transceivers 1512 or 1520 provide wired and/or wireless communications capabilities which allow the luminaires 1506 to be communicatively coupled with the central asset management system 1504 and one or more mobile control systems 1522. For example, in some instances the central asset management system may be implemented as a supervisory control and data acquisition (SCADA) system. In these instances, the transceiver(s) 1512 may include a SCADA transceiver that facilitates wireless communication and/or wired communication, such as communication over a power-line communication system.

The mobile control systems 1522 may include accurate location identification systems, such as global positioning system (GPS) receivers 1524 (FIG. 17) that communicate with GPS satellites 1526 (FIG. 15). The mobile control systems 1522 may also include one or more short-range wired or wireless communications capabilities, such as one or more of Bluetooth®, WiFi®, near field communication (NFC), ANT®, IEEE 802.15 (e.g., ZigBee®), or USB®.

During installation, testing or setup of a luminaire 1506, the mobile control system 1522 positioned proximate the luminaire may transmit its location information (e.g., geographical coordinates) to the luminaire over a data communications channel (e.g., Bluetooth®, Wi-Fi®, USB®). Since the location information is near the luminaire 1506 when the location information is determined, the luminaire may store the received location information as the luminaire's location in the data store 1518, for example. In some implementations, the luminaire may be equipped with a GPS receiver which may be used to obtain the time of day and location of the luminaire. In this regard, each of the installed luminaires "knows" its own geographical location.

In some implementations, each of the luminaires 1506 is programmed with a unique identifier (e.g., identification number, such as a serial number). The unique identifier uniquely identifies the respective luminaire with respect to all other luminaires in an installation, or installed base, asset collection, or inventory of an entity. The unique identifier may be programmed or otherwise stored in the nontransitory data store 1518 during manufacture, during installation, or at any other time. The unique identifier may be programmed using one of the mobile control systems 1522, a factory programming fixture, DIP switches, or using any other suitable method.

Once the luminaires 1506 have received their respective identification information and location information, the luminaires may send such information to the central asset management system 1504 for storage thereby. The central asset management system 1504 may also include mapping functions that generate an asset management map (FIG. 14) which may visually present luminaire information to one or more users. The central asset management system 1504 may also analyze the collected data and generate one or more electronic reports that are valuable for users associated with the illumination system 1500.

The local ICS 1515 may include a photocontrol that has a photosensitive transducer (photosensor) associated therewith. The ICS 1515 may be operative to control operation of the light sources 1510 based on ambient light levels detected by the photosensor. The ICS 1515 may be coupled to the processor 1516 and operative to provide illumination data signals to the processor so that the processor may control the light sources 1510 based on the received illumination data signals. The ICS 1515 may also be configured as a switch that provides electrical power to the light sources 1510 only when detected light levels are below a desired level. For example, the local ICS 1515 of the luminaire 1506 may include a photosensor that controls an electro-mechanical relay coupled between a source of electrical power and a control device (e.g., a magnetic or electronic transformer) within the luminaire. The electro-mechanical relay may be configured to be in an electrically continuous state unless a signal from the photosensor is present to supply power to the luminaire 1506. If the photosensor is illuminated with a sufficient amount of light, the photosensor outputs the signal that causes the electro-mechanical relay to switch to an electrically discontinuous state such that no power is supplied to the luminaire 1506. In some implementations, the ICS 1515 may include one or more clocks or timers, and/or one or more look-up tables or other data structures that indicate dawn events and dusk events for one or more geographical locations at various times during a year. The time of occurrence of various solar events may additionally or alternatively be calculated using geolocation, time, or date data either generated by or stored within a nontransitory processor-readable medium of the luminaire 1506 or obtained from one or more external devices via one or more wired or wireless communication interfaces either in or communicably coupled to the luminaire. In some implementations, the ICS 1515 is implemented partially or fully by the processor 1516.

The power line transceiver 1512 and the power supply 1514 of the luminaire 1506 may each be electrically coupled with the power distribution system 1502 (FIG. 15). The power line transceiver 1512 may transmit and receive power line control or data signals over the power distribution system 1502, and the power supply 1514 may receive a power signal from the power distribution system. The power line transceiver 1512 may separate or decode the power line control or data signals from the power signals and may provide the decoded signals to the luminaire processor 1516. In turn, the luminaire processor 1516 may generate one or more light source control commands that are supplied to the light sources 1510 to control the operation thereof. The power line transceiver 1512 may also encode power line control or data signals and transmit the signals to the central asset management system 1504 via the power distribution system 1502.

The power supply 1514 may receive an AC power signal from the power distribution system 1502, generate a DC power output, and supply the generated DC power output to the light sources 1510 to power the light sources as controlled by light source control commands from the luminaire processor 1516. The light sources 1510 may include one or more of a variety of conventional light sources, for example, incandescent lamps or fluorescent lamps such as high-intensity discharge (HID) lamps (e.g., mercury vapor lamps, high-pressure sodium lamps, metal halide lamps). The light sources 1510 may also include one or more solid-state light sources (e.g., light emitting diodes (LEDs), organic LEDs (OLEDs), polymer LEDs (PLEDs)).

The central asset management system 1504 may receive luminaire information from each of the luminaires 1506 in the illumination system 1500. For example, in some implementations the central asset management system 1504 may interrogate the luminaires 1506 (e.g., via the power distribution system 1502) and receive signals from each of the luminaires that provide luminaire information. In some implementations, the luminaires 1506 may automatically send luminaire information to the central asset management system without interrogation.

The central asset management system 1504 may store the luminaire information in one or more nontransitory computer- or processor-readable media. The luminaire information may include, for example, identification information, location information, installation date, illumination patterns, installation cost, installation details, type of luminaire, maintenance activities, specifications, purchase date, cost, expected lifetime, warranty information, service contracts, service history, spare parts, comments, or anything other information that may be useful to users (e.g., management, analysts, purchasers, installers, maintenance workers).

In some implementations, data communicated between the central asset management system 1504 and the luminaires 1506 may be converted into power line control signals that may be superimposed onto wiring of the power distribution system 1502 so that the signals are transmitted or distributed via the power distribution system. In some implementations, the power line signals may be in the form of amplitude modulation signals, frequency modulation signals, frequency shift keyed signals (FSK), differential frequency shift keyed signals (DFSK), differential phase shift keyed signals (DPSK), or other types of signals. The command code format of the power line signals may be that of a commercially available controller format or may be that of a custom controller format. An example power line communication system is the TWACS® system available from Aclara Corporation, Hazelwood, Miss.

The central asset management system 1504 may utilize a power line transceiver or interface 1658 (see FIG. 16) that includes special coupling capacitors to connect transmitters to power-frequency AC conductors of the power distribution system 1502. Signals may be impressed on one conductor, on two conductors or on all three conductors of a high-voltage AC transmission line. Filtering devices may be applied at substations of the power distribution system 1502 to prevent the carrier frequency current from being bypassed through substation infrastructure. Power line carrier systems may be favored by utilities because they allow utilities to reliably move data over an infrastructure that they control.

In some instances, the power line signals may be in the form of a broadcast signal or command delivered to each of the luminaires 1506 in the illumination system 1500. In some instances, the power line signals may be specifically addressed to an individual luminaire 1506, or to one or more groups or subsets of luminaires.

FIGS. 16 and 17 and the following discussion provide a brief, general description of the components forming the illustrative illumination system 1500 including the central asset management system 1504, the power distribution system 1502, the mobile control systems 1522, and the luminaires 1506 in which the various illustrated implementations can be implemented. Although not required, some portion of the implementations will be described in the general context of computer-executable instructions or logic and/or data, such as program application modules, objects, or macros being executed by a computer. Those skilled in the relevant art will appreciate that the illustrated implementations as well as other implementations can be practiced with other computer system or processor-based device configurations, including handheld devices, for instance Web enabled cellular phones or PDAs, multiprocessor systems, microprocessor-based or programmable consumer electronics, personal computers ("PCs"), network PCs, minicomputers, mainframe computers, and the like. The implementations can be practiced in distributed computing environments where tasks or modules are performed by remote processing devices, which are linked through a communications network. In a distributed computing environment, program modules may be located in both local and remote memory storage devices.

The central asset management system 1504 may take the form of a PC, server, or other computing system executing logic or other machine executable instructions. The central asset management system 1504 includes one or more processors 1606, a system memory 1608 and a system bus 1610 that couples various system components including the system memory 1608 to the processor 1606. The central asset management system 1504 will at times be referred to in the singular herein, but this is not intended to limit the implementations to a single system, since in certain implementations, there will be more than one central asset management system 1504 or other networked computing device involved. Non-limiting examples of commercially available systems include, but are not limited to, an 80×86 or Pentium series microprocessor from Intel Corporation, U.S.A., a PowerPC microprocessor from IBM, a Sparc microprocessor from Sun Microsystems, Inc., a PA-RISC series microprocessor from Hewlett-Packard Company, or a 68xxx series microprocessor from Motorola Corporation.

The central asset management system 1504 may be implemented as a SCADA system or as one or more components thereof. Generally, a SCADA system is a system operating with coded signals over communication channels to provide control of remote equipment. The supervisory system may be combined with a data acquisition system by adding the use of coded signals over communication channels to acquire information about the status of the remote equipment for display or for recording functions.

The processor 1606 may be any logic processing unit, such as one or more central processing units (CPUs), microprocessors, digital signal processors (DSPs), graphics processors (GPUs), application-specific integrated circuits (ASICs), field programmable gate arrays (FPGAs), etc. Unless described otherwise, the construction and operation of the various blocks shown in FIGS. 16 and 17 are of conventional design. As a result, such blocks need not be described in further detail herein, as they will be understood by those skilled in the relevant art.

The system bus 1610 can employ any known bus structures or architectures. The system memory 1608 includes read-only memory ("ROM") 1612 and random access memory ("RAM") 1614. A basic input/output system ("BIOS") 1616, which may be incorporated into at least a portion of the ROM 1612, contains basic routines that help transfer information between elements within the central asset management system 1504, such as during start-up. Some implementations may employ separate buses for data, instructions and power.

The central asset management system 1504 also may include one or more drives 1618 for reading from and writing to one or more nontransitory computer- or processor-readable media 1620 (e.g., hard disk, magnetic disk, optical disk). The drive 1618 may communicate with the processor 1606 via the system bus 1610. The drive 1618 may include interfaces or controllers (not shown) coupled between such drives and the system bus 1610, as is known by those skilled in the art. The drives 1618 and their associated nontransitory computer- or processor-readable media 1620 provide non-volatile storage of computer-readable instructions, data structures, program modules and other data for the central asset management system 1504. Those skilled in the relevant art will appreciate that other types of computer-readable media may be employed to store data accessible by a computer.

Program modules can be stored in the system memory 1608, such as an operating system 1630, one or more application programs 1632, other programs or modules 1634, and program data 1638.

The application program(s) 1632 may include logic capable of providing the luminaire management functionality described herein. For example, applications programs 1632 may include programs to analyze and organize luminaire information automatically received from the luminaires 1506. The application programs 1632 may also include programs to present raw or analyzed illumination information in a format suitable for presentation to a user.

The system memory 1608 may include communications programs 1640 that permit the central asset management system 1504 to access and exchange data with other networked systems or components, such as the luminaires 1506, the mobile control systems 1522, and/or other computing devices.

While shown in FIG. 16 as being stored in the system memory 1608, the operating system 1630, application programs 1632, other programs/modules 1634, program data 1638 and communications 1640 can be stored on the nontransitory computer- or processor-readable media 1620 or other nontransitory computer- or processor-readable media.

Personnel can enter commands (e.g., system maintenance, upgrades) and information (e.g., parameters) into the central asset management system 1504 using one or more communicably coupled input devices 1646 such as a touch screen or keyboard, a pointing device such as a mouse, and/or a push button. Other input devices can include a microphone, joystick, game pad, tablet, scanner, biometric scanning device, etc. These and other input devices may be connected to the processor 1606 through an interface such as a universal serial bus ("USB") interface that couples to the system bus 1610, although other interfaces such as a parallel port, a game port or a wireless interface or a serial port may be used. One or more output devices 1650, such as a monitor or other display device, may be coupled to the system bus 1610 via a video interface, such as a video adapter. In at least some instances, the input devices 1646 and the output devices 1650 may be located proximate the central asset management system 1504, for example when the system is installed at the system user's premises. In other instances, the input devices 1646 and the output devices 1650 may be located remote from the central asset management system 1504, for example, when the system is installed on the premises of a service provider.

In some implementations, the central asset management system 1504 uses one or more of the logical connections to optionally communicate with one or more luminaires 1506, remote computers, servers and/or other devices via one or more communications channels, for example, the one or more networks 1513. These logical connections may facilitate any known method of permitting computers to communicate, such as through one or more LANs and/or WANs. Such networking environments are known in wired and wireless enterprise-wide computer networks, intranets, extranets, and the Internet.

In some implementations, a network port or interface 1656, communicatively linked to the system bus 1610, may be used for establishing and maintaining communications over the communications network 1513.

The central asset management system 1504 may include a power line transceiver or interface 1658 and an AC/DC power supply 1660 that are each electrically coupled to the power distribution system 1502. The AC/DC power supply 1660 converts AC power from the power distribution system 1502 into DC power, which may be provided to power the various components of the central asset management system 1504. As discussed above, the power line interface 1658 may be operative to superimpose control signals onto one or more conductors of the power distribution system 1502 that carries power to the luminaires 1506. The power line interface 1658 may also be operative to decode and receive communication signals sent over the power distribution system 1502 (e.g., from the power line interface 1512 of a luminaire 1506 (FIG. 15)).

In some implementations, the central asset management system 1504 may utilize the one or more wired and/or wireless communications networks 1513 to communicate with the luminaires 1506 instead of or in addition to communicating through the power distribution system 1502.

In the illumination system 1500, program modules, application programs, or data, or portions thereof, can be stored in one or more computing systems. Those skilled in the relevant art will recognize that the network connections shown in FIG. 16 are only some examples of ways of establishing communications between computers, and other connections may be used, including wireless. In some implementations, program modules, application programs, or data, or portions thereof, can even be stored in other computer systems or other devices (not shown).

For convenience, the processor 1606, system memory 1608, network port 1656 and devices 1646, 1650 are illustrated as communicatively coupled to each other via the system bus 1610, thereby providing connectivity between the above-described components. In alternative implementations, the above-described components may be communicatively coupled in a different manner than illustrated in FIG. 16. For example, one or more of the above-described components may be directly coupled to other components, or may be coupled to each other, via intermediary components (not shown). In some implementations, system bus 1610 is omitted and the components are coupled directly to each other using suitable connections.

It should be appreciated that the luminaires 1506 may include components similar to those components present in the central asset management system 1504, including the processor 1606, power supply 1660, power line interface 1658, buses, nontransitory computer- or processor-readable media, wired or wireless communications interfaces, and one or more input and/or output devices.

The mobile control system 1522 can include any device, system or combination of systems and devices having at least wired or wireless communications capabilities. In most instances, the mobile control system 1522 includes additional devices, systems, or combinations of systems and devices capable of providing graphical data display capabilities. Examples of such mobile control systems 1522 can include without limitation, cellular telephones, smart phones, tablet computers, desktop computers, laptop computers, ultraportable or netbook computers, personal digital assistants, handheld devices, other smart appliances, and the like.

In other implementations, the luminaire includes a satellite positioning receiver such as GPS receiver, Glonass, etc., and stores its position data in nontransitory computer- or processor-readable media or memory. The position data may only need to be acquired relatively infrequently, thus enabling location data to be acquired in poor reception areas or with relatively low cost receiver hardware.

The mobile control system 1522 may include one or more processors 1682 and nontransitory computer- or processor-readable media or memory, for instance one or more data stores 1684 that may include nonvolatile memories such as read only memory (ROM) or FLASH memory and/or one or more volatile memories such as random access memory (RAM).

The mobile control system 1522 may include one or more transceivers or radios and associated antennas. For example, the mobile control system 1522 may include one or more cellular transceivers or radios 1688 and one or more short-range transceivers or radios 1690, such as WIFI® transceivers or radios, BLUETOOTH® transceivers or radios, along with associated antennas. The mobile control system 1522 may further include one or more wired interfaces (not shown) that utilize parallel cables, serial cables, or wireless channels capable of high speed communications, for instance, via one or more of FireWire®, Universal Serial Bus® (USB), Thunderbolt®, or Gigabit Ethernet®, for example.

The mobile control system 1522 may include a user input/output subsystem, for example including a touchscreen or touch sensitive display device 1692A and one or more speakers 1692B. The touchscreen or touch sensitive display device 1692A may include any type of touchscreen including, but not limited to, a resistive touchscreen or a capacitive touchscreen. The touchscreen or touch sensitive display device 1692A may present a graphical user interface, for example in the form of a number of distinct screens or windows, which include prompts and/or fields for selection. The touchscreen or touch sensitive display device 1692A may present or display individual icons and controls, for example virtual buttons or slider controls and virtual keyboard or key pads which are used to communicate instructions, commands, and/or data. While not illustrated, the user interface may additionally or alternatively include one or more additional input or output devices, for example an alphanumeric keypad, a QWERTY keyboard, a joystick, scroll wheel, touchpad or similar physical or virtual input device.

In some implementations, the touchscreen 1692A or other input component may include simple adjustment "sliders" to set the current to individual LED arrays. More sophisticated graphical user interfaces (GUIs) may also be used, for example, buttons for selecting NEMA Type 1, NEMA Type 2, or other illumination pattern standards, scheduled dimming selection and other features. The LED driver channel current, dimming schedule, GPS coordinates and other data may be transmitted wirelessly to the luminaire, where such data are stored (e.g., in the data store 1684).

The mobile control system 1522 may include one or more image capture devices 1694, for example, cameras with suitable lenses, and optionally one or more flash or lights for illuminating a field of view to capture images. The image capture device(s) 1694 may capture still digital images or moving or video digital images. Image information may be stored as files via the data store 1684, for example.

Some or all of the components within the mobile control system 1522 may be communicably coupled using at least one bus (not shown) or similar structure adapted to transferring, transporting, or conveying data between the devices, systems, or components used within the mobile control system 1522. The bus can include one or more serial communications links or a parallel communications link such as an 8-bit, 16-bit, 32-bit, or 64-bit data bus. In some implementations, a redundant bus (not shown) may be present to provide failover capability in the event of a failure or disruption of a primary bus.

The processor(s) 1682 may include any type of processor (e.g., ARM Cortext-A8, ARM Cortext-A9, Snapdragon 600, Snapdragon 800, NVidia Tegra 4, NVidia Tegra 4i, Intel Atom Z2580, Samsung Exynos 5 Octa, Apple A7, Motorola X8) adapted to execute one or more machine executable instruction sets, for example a conventional microprocessor, a reduced instruction set computer (RISC) based processor, an application specific integrated circuit (ASIC), digital signal processor (DSP), or similar. Within the processor(s) 1682, a non-volatile memory may store all or a portion of a basic input/output system (BIOS), boot sequence, firmware, startup routine, and communications device operating system (e.g., iOS®, Android®, Windows® Phone, Windows® 8, and similar) executed by the processor 1682 upon initial application of power. The processor(s) 1682 may also execute one or more sets of logic or one or more machine executable instruction sets loaded from volatile memory subsequent to the initial application of power to the processor 1682. The processor 1682 may also include a system clock, a calendar, or similar time measurement devices. One or more geolocation devices, for example a Global Positioning System (GPS) receiver 1524 may be communicably coupled to the processor 1682 to provide additional functionality such as geolocation data to the processor 1682.

The transceivers or radios 1688, 1690 can include any device capable of transmitting and receiving communications via electromagnetic energy.

Non-limiting examples of cellular communications transceivers or radios 1688 include a CDMA transceiver, a GSM transceiver, a 3G transceiver, a 4G transceiver, an LTE transceiver, and any similar current or future developed computing device transceiver having at least one of a voice telephony capability or a data exchange capability. In at least some instances, the cellular transceivers or radios 1688 can include more than one interface. For example, in some instances, the cellular transceivers or radios 1688 can include at least one dedicated, full- or half-duplex, voice call interface and at least one dedicated data interface. In other instances, the cellular transceivers or radios 1688 can include at least one integrated interface capable of contemporaneously accommodating both full- or half-duplex voice calls and data transfer.

Non-limiting examples of WIFI® short-range transceivers or radios 1690 include various chipsets available from Broadcom, including BCM43142, BCM4313, BCM94312MC, BCM4312, and chipsets available from Atmel, Marvell, or Redpine. Non-limiting examples of Bluetooth® short-range transceivers or radios 1688 include various chipsets available from Nordic Semiconductor, Texas Instruments, Cambridge Silicon Radio, Broadcom, and EM Microelectronic.

As noted, the data store 1684 can include non-volatile storage memory and in some implementations may include volatile memory as well. At least a portion of the data store 1684 may be used to store one or more processor executable instruction sets for execution by the processor 1682. In some implementations, all or a portion of the memory may be disposed within the processor 1682, for example in the form of a cache. In some implementations, the memory may be supplemented with one or more slots configured to accept the insertion of one or more removable memory devices such as a secure digital (SD) card, a compact flash (CF) card, a universal serial bus (USB) memory "stick," or the like.

In at least some implementations, one or more sets of logic or machine executable instructions providing applications or "apps" executable by the processor 1682 may be stored in whole or in part in at least a portion of the memory 1684. In at least some instances, the applications may be downloaded or otherwise acquired by the end user, for example using an online marketplace such as the Apple App Store, Amazon Marketplace, or Google Play marketplaces. In some implementations, such applications may start up in response to selection of a corresponding user selectable icon by the user or consumer. The application can facilitate establishing a data link between the mobile control system 1522 and the central asset management system 1504 or the luminaires 1506 via the transceivers or radios 1688, 1690 and communication networks 1513.

Figure 18:
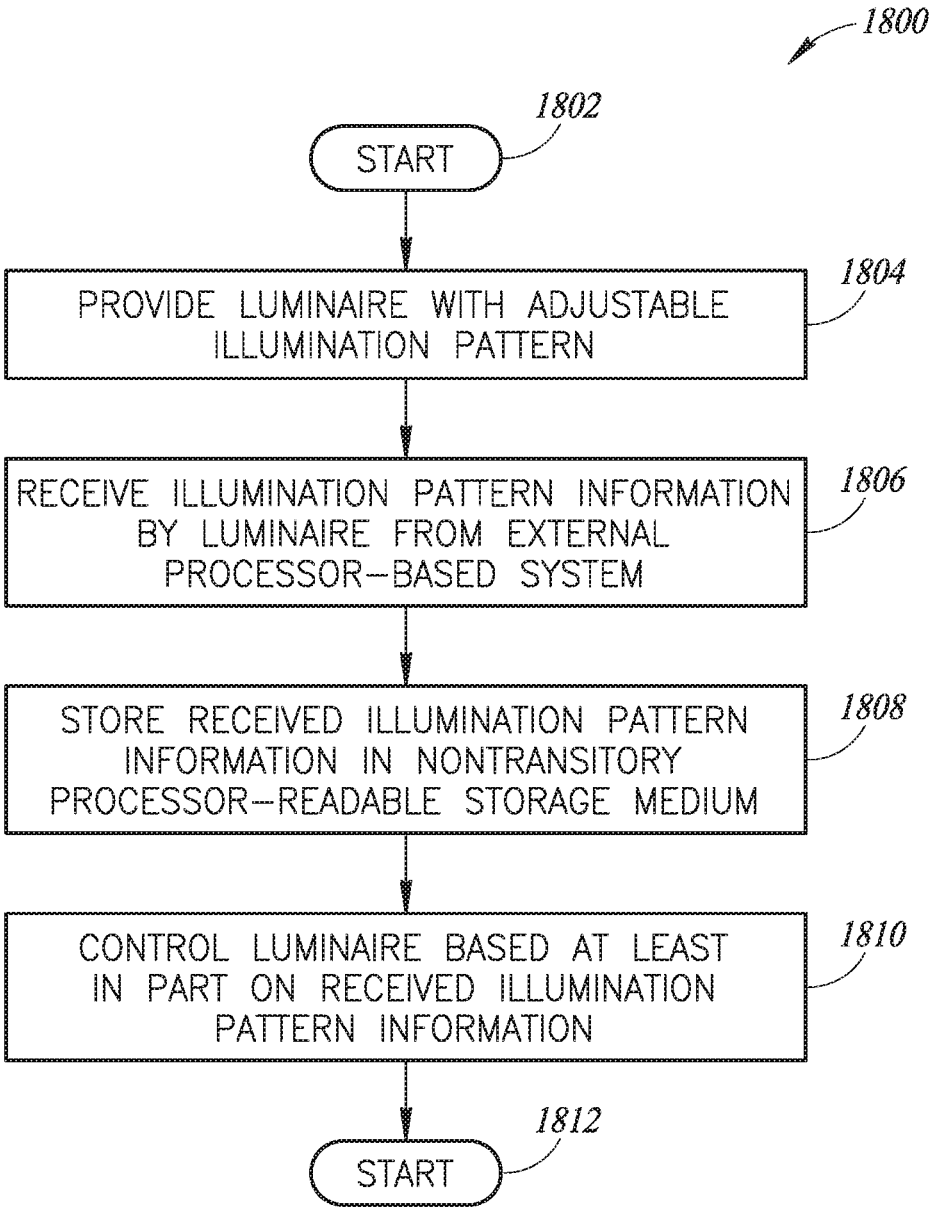
FIG. 18 is a flow diagram showing a method of operation of a processor-based device to provide luminaires in an illumination system with illumination pattern information, according to at least one illustrated implementation.

FIG. 18 is a flow diagram showing a method 1800 of operation of a processor-based device to provide installed luminaires in an illumination system with illumination pattern information. The method 1800 starts at 1802. For example, the method 1800 may start in response to commissioning an illumination system, such as the illumination system 1500 shown in FIG. 15. The method 1800 may also start in response to a need to modify an illumination pattern of a luminaire after installation.

At 1804, a luminaire is provided that includes a housing having a circuit board mounting area. The luminaire also includes at least one circuit board physically coupled to the circuit board mounting area. A number N of solid-state light emitter arrays are carried on the at least one circuit board. Each of the N solid-state light emitter arrays includes a plurality of solid-state light emitters. As discussed above, at least some of the plurality of solid-state light emitters of one of the N solid-state light emitter arrays positioned at a different angle from at least some of the solid-state light emitters of at least one of the other N solid-state light emitter arrays. The luminaire also includes a solid-state light emitter driver including N independently controllable driver channels, at least one luminaire processor operatively coupled to the solid-state light emitter driver to control the operation thereof and at least one luminaire transceiver operatively coupled to the at least one luminaire processor and to at least one data communications channel. The luminaire further includes at least one luminaire nontransitory processor-readable storage medium operatively coupled to the at least one luminaire processor.

At 1806, the luminaire receives, by the at least one luminaire transceiver, illumination pattern information from a remotely located external processor-based system over the at least one data communications channel. As noted above, the illumination pattern information is indicative of an illumination pattern to be produced by the N solid-state light emitter arrays. As an example, the luminaire may receive the illumination pattern information over a power line distribution system (e.g., PLC). The luminaire may also receive the luminaire pattern information wirelessly from a mobile control system positioned proximate to the luminaire. Examples of mobile control systems can include without limitation, cellular telephones, smart phones, tablet computers, desktop computers, laptop computers, ultraportable or netbook computers, personal digital assistants, handheld devices, other smart appliances, and the like. For instance, an installer or technician may stand near an installed luminaire with a mobile control system during installation, testing, modification or setup of the luminaire. As noted above, the mobile control system includes illumination pattern information that may be provided to the luminaire. In some implementations, the mobile control system may include an interface that allows a user to manually input illumination pattern information (e.g., NEMA Type beam pattern, custom beam angles, custom beam shapes) into the mobile control system.

At 1808, the luminaire may store the received illumination pattern information on the at least one nontransitory processor-readable storage medium. At 1810, the luminaire may control the operation of the solid-state light emitter driver based at least in part on the illumination pattern information.

The method 1800 ends at 1812 until started or invoked again. For example, the method 1800 may be performed for each luminaire in an illumination system during setup of the luminaire or when an illumination pattern for the luminaire is to be modified. The method 1800 may also be repeated for a luminaire after certain events, such as a maintenance event or a relocation event.

The foregoing detailed description has set forth various implementations of the devices and/or processes via the use of block diagrams, schematics, and examples. Insofar as such block diagrams, schematics, and examples contain one or more functions and/or operations, it will be understood by those skilled in the art that each function and/or operation within such block diagrams, flowcharts, or examples can be implemented, individually and/or collectively, by a wide range of hardware, software, firmware, or virtually any combination thereof. In one implementation, the present subject matter may be implemented via Application Specific Integrated Circuits (ASICs). However, those skilled in the art will recognize that the implementations disclosed herein, in whole or in part, can be equivalently implemented in standard integrated circuits, as one or more computer programs running on one or more computers (e.g., as one or more programs running on one or more computer systems), as one or more programs running on one or more controllers (e.g., microcontrollers) as one or more programs running on one or more processors (e.g., microprocessors), as firmware, or as virtually any combination thereof, and that designing the circuitry and/or writing the code for the software and or firmware would be well within the skill of one of ordinary skill in the art in light of this disclosure.

Those of skill in the art will recognize that many of the methods or algorithms set out herein may employ additional acts, may omit some acts, and/or may execute acts in a different order than specified.

In addition, those skilled in the art will appreciate that the mechanisms taught herein are capable of being distributed as a program product in a variety of forms, and that an illustrative implementation applies equally regardless of the particular type of signal bearing media used to actually carry out the distribution. Examples of signal bearing media include, but are not limited to, the following: recordable type media such as floppy disks, hard disk drives, CD ROMs, digital tape, and computer memory.

The various implementations described above can be combined to provide further implementations. To the extent that they are not inconsistent with the specific teachings and definitions herein, all of the U.S. patents, U.S. patent application publications, U.S. patent applications, foreign patents, foreign patent applications and non-patent publications referred to in this specification and/or listed in the Application Data Sheet, including but not limited to U.S. Provisional Patent Application No. 61/052,924, filed May 13, 2008; U.S. Pat. No. 8,926,138, issued Jan. 6, 2015; PCT Publication No. WO2009/140141, published Nov. 19, 2009; U.S. Provisional Patent Application No. 61/051,619, filed May 8, 2008; U.S. Pat. No. 8,118,456, issued Feb. 21, 2012; PCT Publication No. WO2009/137696, published Nov. 12, 2009; U.S. Provisional Patent Application No. 61/088,651, filed Aug. 13, 2008; U.S. Pat. No. 8,334,640, issued Dec. 18, 2012; U.S. Provisional Patent Application No. 61/115,438, filed Nov. 17, 2008; U.S. Provisional Patent Application No. 61/154,619, filed Feb. 23, 2009; U.S. Patent Publication No. 2010/0123403, published May 20, 2010; U.S. Non-provisional patent application Ser. No. 14/806,500, filed Jul. 22, 2015; PCT Publication No. WO2010/057115, published May 20, 2010; U.S. Provisional Patent Application No. 61/174,913, filed May 1, 2009; U.S. Pat. No. 8,926,139, issued Jan. 6, 2015; PCT Publication No. WO2010/127138, published Nov. 4, 2010; U.S. Provisional Patent Application No. 61/180,017, filed May 20, 2009; U.S. Pat. No. 8,872,964, issued Oct. 28, 2014; U.S. Patent Publication No. 2015/0015716, published Jan. 15, 2015; PCT Publication No. WO2010/135575, published Nov. 25, 2010; U.S. Provisional Patent Application No. 61/229,435, filed Jul. 29, 2009; U.S. Patent Publication No. 2011/0026264, published Feb. 3, 2011; U.S. Provisional Patent Application No. 61/295,519, filed Jan. 15, 2010; U.S. Provisional Patent Application No. 61/406,490, filed Oct. 25, 2010; U.S. Pat. No. 8,378,563, issued Feb. 19, 2013; PCT Publication No. WO2011/088363, published Jul. 21, 2011; U.S. Provisional Patent Application No. 61/333,983, filed May 12, 2010; U.S. Pat. No. 8,541,950, issued Sep. 24, 2013; PCT Publication No. WO2010/135577, published Nov. 25, 2010; U.S. Provisional Patent Application No. 61/346,263, filed May 19, 2010; U.S. Pat. No. 8,508,137, issued Aug. 13, 2013; U.S. Pat. No. 8,810,138, issued Aug. 19, 2014; U.S. Pat. No. 8,987,992, issued Mar. 24, 2015; PCT Publication No. WO2010/135582, published Nov. 25, 2010; U.S. Provisional Patent Application No. 61/357,421, filed Jun. 22, 2010; U.S. Patent Publication No. 2011/0310605, published Dec. 22, 2011; PCT Publication No. WO2011/163334, published Dec. 29, 2011; U.S. Pat. No. 8,901,825, issued Dec. 2, 2014; U.S. Patent Publication No. 2015/0084520, published Mar. 26, 2015; PCT Publication No. WO2012/142115, published Oct. 18, 2012; U.S. Pat. No. 8,610,358, issued Dec. 17, 2013; U.S. Provisional Patent Application No. 61/527,029, filed Aug. 24, 2011; U.S. Pat. No. 8,629,621, issued Jan. 14, 2014; PCT Publication No. WO2013/028834, published Feb. 28, 2013; U.S. Provisional Patent Application No. 61/534,722, filed Sep. 14, 2011; U.S. Patent Publication No. 2013/0062637, published Mar. 14, 2013; PCT Publication No. WO2013/040333, published Mar. 21, 2013; U.S. Provisional Patent Application No. 61/567,308, filed Dec. 6, 2011; U.S. Patent Publication No. 2013/0163243, published Jun. 27, 2013; U.S. Provisional Patent Application No. 61/561,616, filed Nov. 18, 2011; U.S. Patent Publication No. 2013/0141010, published Jun. 6, 2013; PCT Publication No. WO2013/074900, published May 23, 2013; U.S. Provisional Patent Application No. 61/641,781, filed May 2, 2012; U.S. Patent Publication No. 2013/0293112, published Nov. 7, 2013; U.S. Patent Publication No. 2013/0229518, published Sep. 5, 2013; U.S. Provisional Patent Application No. 61/640,963, filed May 1, 2012; U.S. Patent Publication No. 2013/0313982, published Nov. 28, 2013; U.S. Patent Publication No. 2014/0028198, published Jan. 30, 2014; U.S. Non-provisional patent application Ser. No. 14/816,754, filed Aug. 3, 2015; PCT Publication No. WO2014/018773, published Jan. 30, 2014; U.S. Provisional Patent Application No. 61/723,675, filed Nov. 7, 2012; U.S. Patent Publication No. 2014/015955, published Jun. 12, 2014; U.S. Provisional Patent Application No. 61/692,619, filed Aug. 23, 2012; U.S. Patent Publication No. 2014/0055990, published Feb. 27, 2014; U.S. Provisional Patent Application No. 61/694,159, filed Aug. 28, 2012; U.S. Pat. No. 8,878,440, issued Nov. 4, 2014; U.S. Patent Publication No. 2014/0062341, published Mar. 6, 2014; U.S. Patent Publication No. 2015/0077019, published Mar. 19, 2015; PCT Publication No. WO2014/039683, published Mar. 13, 2014; U.S. Provisional Patent Application No. 61/728,150, filed Nov. 19, 2012; U.S. Patent Publication No. 2014/0139116, published May 22, 2014; U.S. Non-provisional patent application Ser. No. 14/950,823, filed Nov. 24, 2015; PCT Publication No. WO2014/078854, published May 22, 2014; U.S. Provisional Patent Application No. 61/764,395, filed Feb. 13, 2013; U.S. Patent Publication No. 2014/0225521, published Aug. 14, 2014; U.S. Provisional Patent Application No. 61/849,841, filed Jul. 24, 2013; U.S. Patent Publication No. 2015/0028693, published Jan. 29, 2015; PCT Publication No. WO2015/013437, published Jan. 29, 2015; U.S. Provisional Patent Application No. 61/878,425, filed Sep. 16, 2013; U.S. Patent Publication No. 2015/0078005, published Mar. 19, 2015; PCT Publication No. WO2015/039120, published Mar. 19, 2015; U.S. Provisional Patent Application No. 61/933,733, filed Jan. 30, 2014; U.S. Pat. No. 9,185,777, issued Nov. 10, 2015; PCT Publication No. WO2015/116812, published Aug. 6, 2015; U.S. Provisional Patent Application No. 61/905,699, filed Nov. 18, 2013; U.S. Patent Publication No. 2015/0137693, published May 21, 2015; U.S. Provisional Patent Application No. 62/068,517, filed Oct. 24, 2014; U.S. Provisional Patent Application No 62/183,505, filed Jun. 23, 2015; U.S. Non-provisional patent application Ser. No. 14/869,492, filed Sep. 29, 2015; PCT Application No. PCT/US2015/53000, filed Sep. 29, 2015; U.S. Provisional Patent Application No. 62/082,463, filed Nov. 20, 2014; U.S. Non-provisional patent application Ser. No. 14/869,501, filed Sep. 29, 2015; PCT Application No. PCT/US2015/53006, filed Sep. 29, 2015; U.S. Provisional Patent Application No. 62/057,419, filed Sep. 30, 2014; U.S. Non-provisional patent application Ser. No. 14/869,511, filed Sep. 29, 2015; PCT Application No. PCT/US2015/53009, filed Sep. 29, 2015; U.S. Provisional Patent Application No. 62/114,826, filed Feb. 11, 2015; U.S. Non-provisional patent application Ser. No. 14/939,856, filed Nov. 12, 2015; U.S. Provisional Patent Application No. 62/137,666, filed Mar. 24, 2015; U.S. Non-provisional patent application Ser. No. 14/844,944, filed Sep. 3, 2015; U.S. Provisional Patent Application No. 62/208,403, filed Aug. 21, 2015; and U.S. Provisional Patent Application No. 62/264,694, filed Dec. 8, 2015 are incorporated herein by reference, in their entirety. Aspects of the implementations can be modified, if necessary, to employ systems, circuits and concepts of the various patents, applications and publications to provide yet further implementations.

These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. A luminaire, comprising:

an active light source which emits light across a plurality of wavelengths;

at least one transmissive filter positioned in a first portion of an optical path of the active light source between the active light source and an optical exit of the luminaire to receive an incident portion of the emitted light, the at least one transmissive filter positioned outside of a second portion of the optical path such that a non-incident portion of the emitted light in the second portion of the optical path exits the optical exit of the luminaire without striking the at least one transmissive filter, the at least one transmissive filter transmits light of the incident portion having a wavelength in a first set of wavelengths in the plurality of wavelengths and reflects light of the incident portion having a wavelength in a second set of wavelengths in the plurality of wavelengths; and a wavelength shifter positioned and oriented to receive the transmitted portion of the incident portion and in response emit light at a shifted wavelength toward the optical exit of the luminaire.

2. The luminaire of claim 1 wherein the wavelength shifter comprises molded plastic loaded with phosphor.

3. The luminaire of claim 1 wherein the wavelength shifter comprises a layer of coating disposed on at least one exterior-facing surface of the at least one transmissive filter.

4. The luminaire of claim 1 wherein the at least one transmissive filter comprises a substrate having a dielectric coating thereon.

5. The luminaire of claim 1 wherein the at least one transmissive filter comprises a layer of coating disposed on at least one light source-facing surface of the wavelength shifter.

6. The luminaire of claim 1 wherein the active light source comprises at least one solid state light source.

7. The luminaire of claim 1 wherein the active light source comprises at least one light emitting diode.

8. The luminaire of claim 1 wherein the wavelength shifter comprises at least one phosphor material.

9. The luminaire of claim 1 wherein the at least one transmissive filter comprises an optical element and a number of layers of at least one of a dichroic coating or a dielectric mirror material carried by the optical element.

10. The luminaire of claim 9 wherein the optical element is at least part of the optical exit of the luminaire.

11. The luminaire of claim 1, further comprising:

a lens positioned and oriented to receive the shifted emitted light from the wavelength shifter and in response emit light which is at least one of refracted or diffracted toward the optical exit of the luminaire.

12. The luminaire of claim 1 wherein the first set of wavelengths includes wavelengths below approximately 480 nanometers and the second set of wavelengths includes wavelengths above approximately 480 nanometers, and the wavelength shifter emits light at wavelengths above approximately 480 nanometers.

13. The luminaire of claim 1, further comprising:

at least one circuit board;

wherein the active light source comprises:

a number N of solid-state light emitter arrays carried on the at least one circuit board, the number N greater than or equal to two, each of the N solid-state light emitter arrays including a plurality of solid-state light emitters, at least some of the plurality of solid-state light emitters of one of the N solid-state light emitter arrays positioned at a different angle from at least some of the solid-state light emitters of at least one of the other N solid-state light emitter arrays;

a solid-state light emitter driver including N independently controllable driver channels, each of the N driver channels electrically coupled to a different one of the N solid-state light emitter arrays;

at least one luminaire processor operatively coupled to the solid-state light emitter driver to control the operation thereof;

at least one luminaire transceiver operatively coupled to the at least one luminaire processor and to at least one data communications channel; and at least one luminaire nontransitory processor-readable storage medium operatively coupled to the at least one luminaire processor and which stores at least one of data or instructions which, when executed by the at least one luminaire processor, cause the at least one luminaire processor to:

receive, via the at least one luminaire transceiver, illumination pattern information from a remotely located external processor-based system over the at least one data communications channel, the illumination pattern information indicative of an illumination pattern to be produced by the N solid-state light emitter arrays;

store the received illumination pattern information in the at least one nontransitory processor-readable storage medium; and control the operation of the solid-state light emitter driver based at least in part on the illumination pattern information.

14. The luminaire of claim 13 wherein the received illumination pattern information specifies an instruction to control the solid-state light emitter driver to drive at least one of the N independently controllable driver channels differently from the other of the N independently controllable driver channels.

15. The luminaire of claim 13 wherein the received illumination pattern information specifies an instruction to control the solid-state light emitter driver to drive each of the N independently controllable driver channels so that the plurality of solid-state light emitters of the N solid-state light emitter arrays produce at least one of a plurality of determined standardized illumination patterns.

16. The luminaire of claim 13 wherein the received illumination pattern information specifies an instruction to control the solid-state light emitter driver to drive each of the N independently controllable driver channels so that the plurality of solid-state light emitters of the N solid-state light emitter arrays produce at least one of a National Electrical Manufacturers Association (NEMA) illumination pattern or an Illuminating Engineering Society of North America (IESNA) illumination pattern.

17. The luminaire of claim 13 wherein the received illumination pattern information specifies an instruction to control the solid-state light emitter driver to drive each of the N independently controllable driver channels so that each of the plurality of solid-state light emitters of at least one of the N solid-state light emitter arrays are at least one of disabled or dimmed.

18. The luminaire of claim 13 wherein the at least one circuit board is a flexible printed circuit board.

19. The luminaire of claim 13 wherein the at least one luminaire transceiver receives the illumination pattern information from the external processor-based system over at least one radio or microwave frequency channel.

20. The luminaire of claim 13 wherein the at least one luminaire transceiver receives the illumination pattern information from the external processor-based system over at least one of a short-range wireless channel or a wired communications channel.

21. The luminaire of claim 13 wherein the at least one luminaire transceiver receives the illumination pattern information from the external processor-based system through at least one power-line power distribution system.

22. The luminaire of claim 13 wherein the at least one luminaire transceiver receives the illumination pattern information from at least one of a smartphone, a tablet computer, or a notebook computer.

23. The luminaire of claim 13 wherein the at least one luminaire transceiver receives the illumination pattern information from the external processor-based system over the at least one data communications channel, the illumination pattern information indicative of a notification illumination pattern to be produced by the N solid-state light emitter arrays, the notification illumination pattern provides a notification to humans that view the luminaire when the plurality of solid-state light emitters are illuminated according to the notification illumination pattern.

24. A method of providing a luminaire, the method comprising:

providing an active light source;

positioning at least one transmissive filter in a first portion of an optical path of the active light source between the active light source and an optical exit of the luminaire to receive an incident portion of light emitted from the active light source, the at least one transmissive filter positioned outside of a second portion of the optical path such that a non-incident portion of the emitted light in the second portion of the optical path exits the optical exit of the luminaire without striking the at least one transmissive filter, the at least one transmissive filter transmits light of the incident portion having a wavelength in a first set of wavelengths and reflects light of the incident portion having a wavelength in a second set of wavelengths; and positioning and orienting a wavelength shifter to receive the transmitted portion of the incident portion and in response emit light at a shifted wavelength toward the optical exit of the luminaire.

25. The method of claim 24 wherein positioning and orienting a wavelength shifter comprises positioning and orienting a wavelength shifter which comprises molded plastic loaded with phosphor.

26. The method of claim 24 wherein positioning and orienting a wavelength shifter comprises positioning and orienting a wavelength shifter which comprises a layer of coating disposed on at least one exterior facing surface of the at least one transmissive filter.

27. The method of claim 24 wherein positioning at least one transmissive filter comprises positioning at least one transmissive filter comprising a substrate having a dielectric coating thereon.

28. The method of claim 24 wherein positioning at least one transmissive filter comprises positioning at least one transmissive filter comprising a layer of coating disposed on at least one light-source facing surface of the wavelength shifter.

29. The method of claim 24 wherein positioning at least one transmissive filter in a first portion of an optical path of an active light source comprises positioning at least one transmissive filter in a first portion of an optical path of at least one solid state light source.

30. The method of claim 24 wherein positioning at least one transmissive filter in a first portion of an optical path of an active light source comprises positioning at least one transmissive filter in a first portion of an optical path of at least one light emitting diode.

31. The method of claim 24 wherein positioning and orienting a wavelength shifter comprises positioning and orienting a wavelength shifter which comprises at least one phosphor material.

32. The method of claim 24 wherein positioning at least one transmissive filter comprises positioning at least one transmissive filter comprising an optical element and a number of layers of at least one of a dichroic coating or a dielectric mirror material carried by the optical element.

33. The method of claim 24, further comprising:

positioning and orienting a lens to receive the shifted emitted light from the wavelength shifter and in response emit light which is at least one of refracted or diffracted toward the optical exit of the luminaire.

34. The method of claim 24 wherein positioning at least one transmissive filter comprises positioning at least one transmissive filter which transmits light having a wavelength below approximately 480 nanometers and reflects light having a wavelength above 480 nanometers, and positioning and orienting a wavelength shifter comprises positioning and orienting a wavelength shifter which emits light at wavelengths above 480 nanometers.

35. The method of claim 24 wherein providing an active light source includes providing an active light source which includes:

at least one circuit board;

a number N of solid-state light emitter arrays carried on the at least one circuit board, the number N greater than or equal to two, each of the N solid-state light emitter arrays including a plurality of solid-state light emitters, at least some of the plurality of solid-state light emitters of one of the N solid-state light emitter arrays positioned at a different angle from at least some of the solid-state light emitters of at least one of the other N solid-state light emitter arrays;

a solid-state light emitter driver including N independently controllable driver channels, each of the N driver channels electrically coupled to a different one of the N solid-state light emitter arrays;

at least one luminaire processor operatively coupled to the solid-state light emitter driver to control the operation thereof;

at least one luminaire transceiver operatively coupled to the at least one luminaire processor and to at least one data communications channel; and at least one luminaire nontransitory processor-readable storage medium operatively coupled to the at least one luminaire processor;

the method further comprises:

receiving, by the at least one luminaire transceiver, illumination pattern information from a remotely located external processor-based system over the at least one data communications channel, the illumination pattern information indicative of an illumination pattern to be produced by the N solid-state light emitter arrays;

storing the received illumination pattern information in the at least one nontransitory processor-readable storage medium; and controlling the operation of the solid-state light emitter driver based at least in part on the illumination pattern information.

36. The method of claim 35 wherein receiving illumination pattern information comprises receiving an illumination pattern information that specifies an instruction to control the solid-state light emitter driver to drive at least one of the N independently controllable driver channels differently from the other of the N independently controllable driver channels.

37. The method of claim 35 wherein receiving illumination pattern information comprises receiving an illumination pattern information that specifies an instruction to control the solid-state light emitter driver to drive each of the N independently controllable driver channels so that the plurality of solid-state light emitters of the N solid-state light emitter arrays produce a determined standardized illumination pattern.

38. The method of claim 35 wherein receiving illumination pattern information comprises receiving an illumination pattern information that specifies an instruction to control the solid-state light emitter driver to drive each of the N independently controllable driver channels so that the plurality of solid-state light emitters of the N solid-state light emitter arrays produce at least one of a National Electrical Manufacturers Association (NEMA) illumination pattern or an Illuminating Engineering Society of North America (IESNA) illumination pattern.

39. The method of claim 35 wherein receiving illumination pattern information comprises receiving an illumination pattern information that specifies an instruction to control the solid-state light emitter driver to drive each of the N independently controllable driver channels so that each of the plurality of solid-state light emitters of at least one of the N solid-state light emitter arrays are disabled.

40. The method of claim 35 wherein receiving illumination pattern information comprises receiving illumination pattern information from the external processor-based system over at least one radio or microwave frequency channel.

41. The method of claim 35 wherein receiving illumination pattern information comprises receiving illumination pattern information from the external processor-based system over at least one of a short-range wireless channel or a wired communications channel.

42. The method of claim 35 wherein receiving illumination pattern information comprises receiving illumination pattern information from the external processor-based system through at least one power-line power distribution system.

43. The method of claim 35 wherein receiving illumination pattern information comprises receiving illumination pattern information from at least one of a smartphone, a tablet computer, or a notebook computer.

44. The method of claim 35 wherein receiving illumination pattern information comprises receiving illumination pattern information from the external processor-based system over the at least one data communications channel, the illumination pattern information indicative of a notification illumination pattern to be produced by the N solid-state light emitter arrays, the notification illumination pattern providing a notification to humans that view the luminaire when the plurality of solid-state light emitters are illuminated according to the notification illumination pattern.

* * * * *